US010031471B1

(12) United States Patent
Arata

(10) Patent No.: US 10,031,471 B1
(45) Date of Patent: Jul. 24, 2018

(54) TONER CASE AND IMAGE FORMING APPARATUS

(71) Applicant: KYOCERA Document Solutions Inc., Osaka (JP)

(72) Inventor: Tatsuro Arata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/872,391

(22) Filed: Jan. 16, 2018

(30) Foreign Application Priority Data

Jan. 24, 2017 (JP) ..... 2017-010196

(51) Int. Cl.
*G03G 15/08* (2006.01)
*G03G 21/16* (2006.01)

(52) U.S. Cl.
CPC ..... *G03G 21/1647* (2013.01); *G03G 15/0837* (2013.01); *G03G 15/0839* (2013.01); *G03G 15/0886* (2013.01)

(58) Field of Classification Search
CPC ..... G03G 15/0837; G03G 15/0839; G03G 15/0886; G03G 21/1647
See application file for complete search history.

(56) References Cited

U.S. PATENT DOCUMENTS 6,259,877 B1 * 7/2001 Taniyama ..... G03G 15/0872 222/DIG. 1
8,099,028 B2 * 1/2012 Yamada ..... G03G 15/0886 399/262

FOREIGN PATENT DOCUMENTS

JP 2001-305841 A 11/2001

* cited by examiner

*Primary Examiner* — Hoang Ngo
(74) *Attorney, Agent, or Firm* — Studebaker & Brackett PC

(57) ABSTRACT

A toner case includes a case main body, a rotator, a transmitter and a mover. The transmitter is arranged outside the case main body and transmits rotation to the rotator. The transmitter moves along a rotation axis direction of the rotator between a first position and a second position arranged at an outside of the first position in the rotation axis direction. The mover attached to the transmitter moves along the rotation axis direction between a first moved position and a second moved position arranged at an outside of the first moved position in the rotation axis direction. As the mover moves from the second moved position to the first moved position, the transmitter moves from the second position to the first position. As the mover moves from the first moved position to the second moved position, the transmitter moves from the first position to the second position.

14 Claims, 23 Drawing Sheets

TONER CASE AND IMAGE FORMING APPARATUS

INCORPORATION BY REFERENCE

This application is based on and claims the benefit of priority from Japanese patent application No. 2017-010196 filed on Jan. 24, 2017, which is incorporated by reference in its entirety.

BACKGROUND

The present disclosure relates to a toner case and an image forming apparatus including the toner case.

An image forming apparatus, such as a printer, a copying machine, a facsimile and a printer, includes a toner case which replenishes a developing device with a toner (a developer). For instance, the toner case includes a case main body storing the toner, a rotator stored in the case main body and rotating around a rotation axis and a transmitter arranged outside the case main body and transmitting rotation to the rotator. In such a toner case, by transmitting the rotation from the transmitter to the rotator, the toner in the case main body is agitated or conveyed by the rotator.

SUMMARY

In accordance with an aspect of the present disclosure, a toner case includes a case main body, a rotator, a transmitter and a mover. The case main body stores a toner. The rotator rotates around a rotation axis. At least apart of the rotator is stored in the case main body. The transmitter is arranged outside the case main body and transmits rotation to the rotator. The mover is arranged outside the case main body and attached to the transmitter. The transmitter moves along a rotation axis direction of the rotator between a first position and a second position which is arranged at an outside of the first position in the rotation axis direction. The mover moves along the rotation axis direction between a first moved position and a second moved position which is arranged at an outside of the first moved position in the rotation axis direction. As the mover moves from the second moved position to the first moved position, the transmitter moves from the second position to the first position. As the mover moves from the first moved position to the second moved position, the transmitter moves from the first position to the second position.

In accordance with an aspect of the present disclosure, an image forming apparatus includes the toner case and an attachment part to which the toner case is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A First Embodiment

Hereinafter, a first embodiment of the present disclosure will be described with reference to FIG. 1 to FIG. 14.

Figure 1:
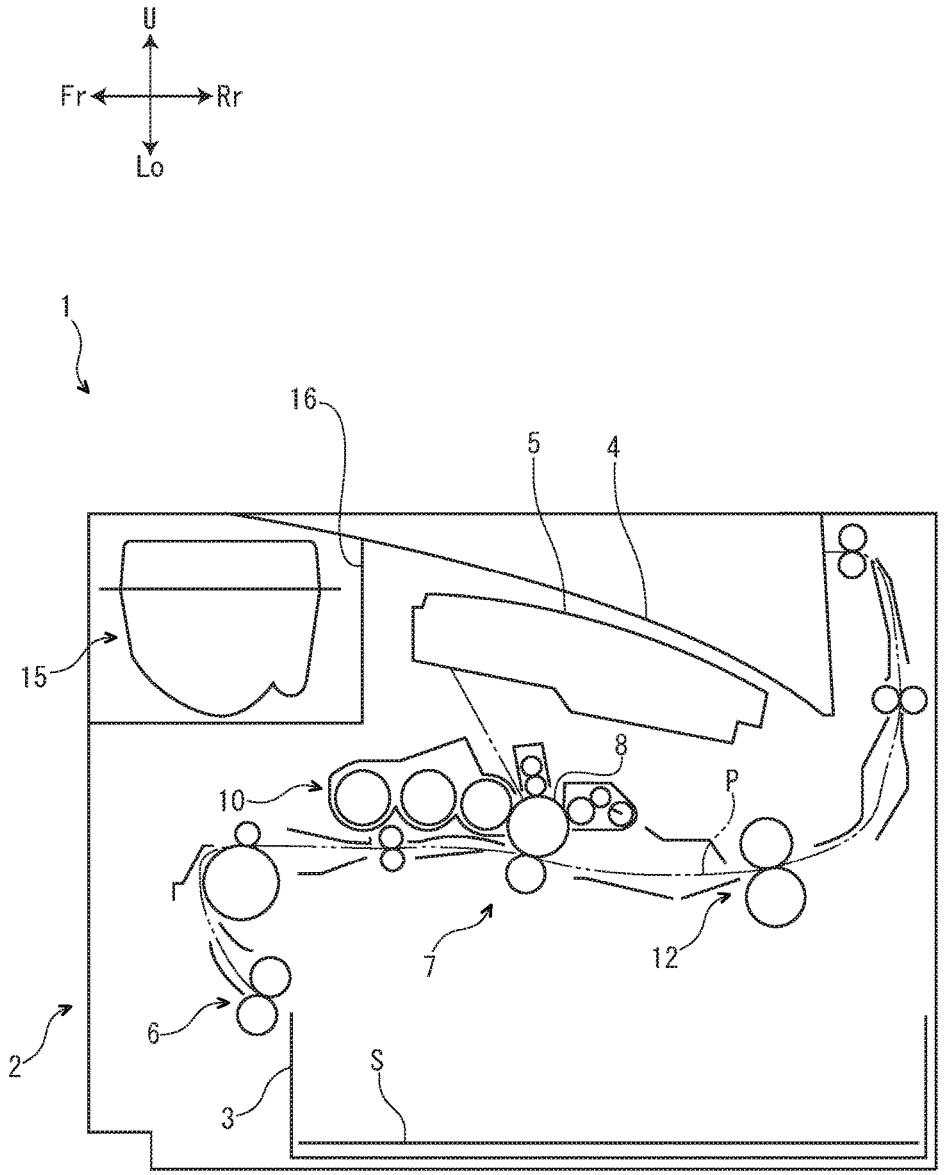
FIG. 1 is a schematic view showing a printer according to a first embodiment of the present disclosure.

Firstly, an entire structure of a printer 1 (an example of an image forming apparatus) will be described. In the following description, for convenience of explanation, a left side on FIG. 1 is defined to be a front side of the printer 1. Arrows Fr, Rr, L, R, U and Lo shown in each figure respectively indicate a front side, a rear side, a left side, a right side, an upper side and a lower side of the printer 1.

With reference to FIG. 1, the printer 1 includes a box-shaped printer main body 2 (an example of an apparatus main body). In a lower portion of the printer main body 2, a sheet feeding cassette 3 storing a sheet S (an example of a recording medium) is stored. On an upper face of the printer main body 2, an ejected sheet tray 4 is provided. In an upper portion of the printer main body 2, an exposing device 5 is stored below the ejected sheet tray 4.

Inside the printer main body 2, a conveying path P for the sheet S is provided. At an upstream end of the conveying path P, a sheet feeding part 6 is provided. At a middle portion of the conveying path P, an image forming part 7 is provided. The image forming part 7 includes a photosensitive drum 8 and a developing device 10. Ata downstream portion of the conveying path P, a fixing device 12 is provided.

In a front upper portion of the printer main body 2, a toner container 15 (an example of a toner case) is stored. The toner container 15 is detachably attached to an attachment part 16.

Next, an operation of the printer 1 having the above described configuration will be described.

Firstly, laser light (refer to a two-dot line in FIG. 1) emitted from the exposing device 5 exposes the photosensitive drum 8 to form an electrostatic latent image on the photosensitive drum 8. Next, the electrostatic latent image on the photosensitive drum 8 is developed by the developing device 10 to a toner image. Thereby, an image forming operation is finished.

On the other hand, the sheet S fed from the sheet feeding cassette 3 by the sheet feeding part 6 is conveyed to the image forming part 7 synchronously with the above described image forming operation. At the image forming part 7, the above toner image is transferred on the sheet S from the photosensitive drum 8. The sheet S on which the toner image is transferred is conveyed to the downstream side along the conveying path P and enters the fixing device 12. The fixing device 12 fixes the toner image on the sheet S. The sheet S on which the toner image is fixed is ejected on the ejected sheet tray 4 from a downstream end of the conveying path P.

Next, the toner container 15 will be described in detail.

Figure 2:
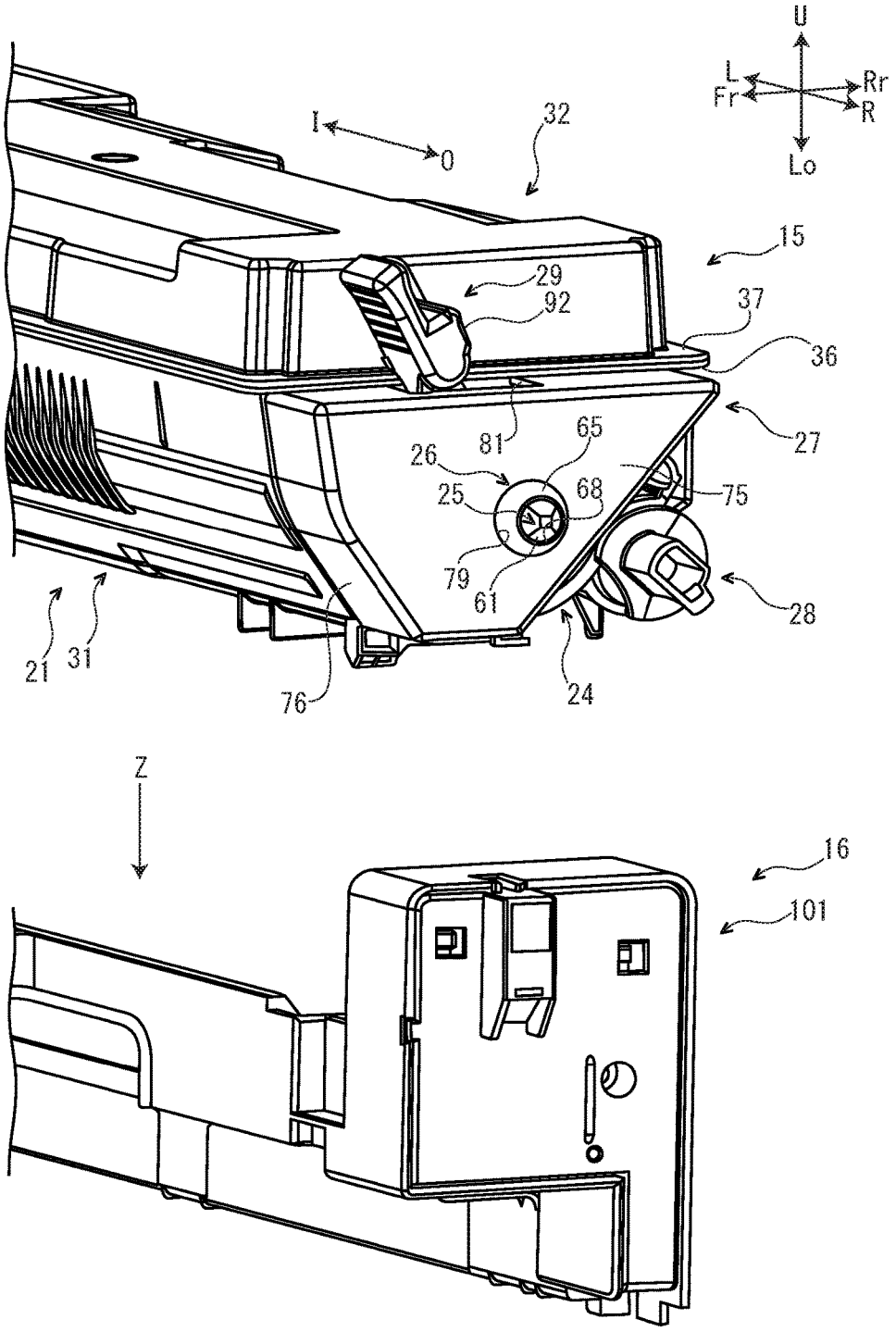
FIG. 2 is a perspective view showing a right side portion of a toner container and a right side portion of an attachment part according to the first embodiment of the present disclosure.

An arrow O shown in each figure after FIG. 2 indicates an outside in the left-and-right direction of the toner container 15, and an arrow I shown in each figure after FIG. 2 indicates an inside in the left-and-right direction of the toner container 15.

Figure 3:
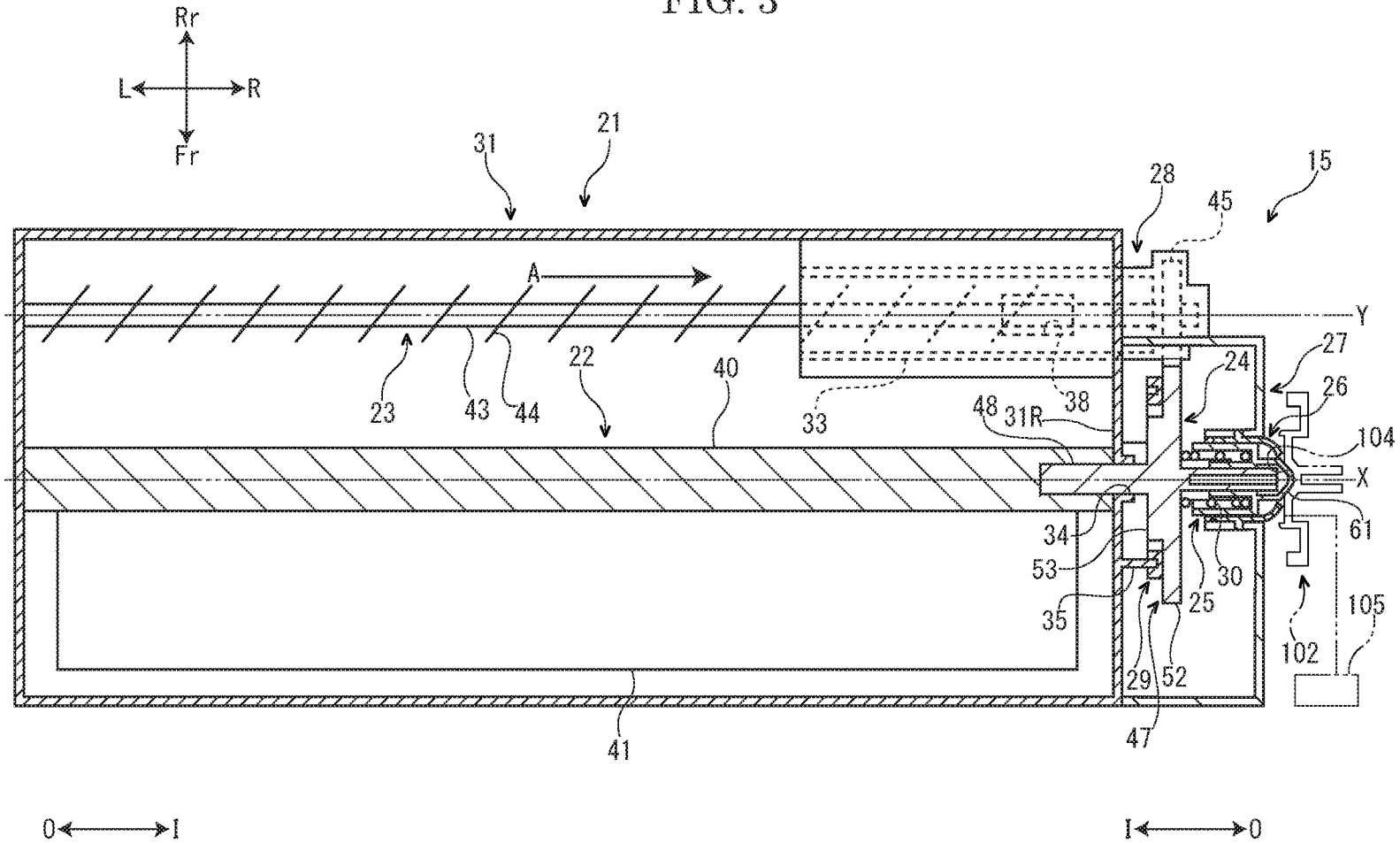
FIG. 3 is a sectional view schematically showing the toner container according to the first embodiment of the present disclosure.

With reference to FIG. 2 and FIG. 3, the toner container 15 includes a case main body 21, an agitator 22 (an example of a rotator) stored in a center portion of the case main body 21, a conveyer 23 (an example of a rotator) stored in a rear lower portion of the case main body 21, a supporter 24 arranged at a right end side of the case main body 21, a transmitter 25 arranged at a right side (the outside in the left-and-right direction) of the supporter 24, a mover 26 attached to the transmitter 25, a cover 27 covering a right side (the outside in the left-and-right direction) of the case main body 21, a shutter 28 arranged at a rear lower side of a right end portion of the case main body 21, a manipulation member 29 arranged at the right side (the outside in the left-and-right direction) of the case main body 21 and a coil spring 30 (an example of a biasing member) arranged between the supporter 24 and the transmitter 25.

The case main body 21 of the toner container 15 has a shape elongated in the left-and-right direction. The case main body 21 stores a toner (a developer). The case main body 21 includes a storage 31, a lid 32 provided at an upper side of the storage 31 and a duct 33 provided at a rear lower side of a right end portion of the storage 31.

The storage 31 of the case main body 21 is formed in a box-like shape whose upper side is opened. In a center portion of a right side wall 31R of the storage 31, a supporting hole 34 is provided. On a right face (a face at the outside in the left-and-right direction) of the right side wall 31R of the storage 31, a supporting rib 35 is protruded around an outer circumference of the supporting hole 34. Around an upper end of an outer circumference of the storage 31, a lower side flange 36 is provided.

The lid 32 of the case main body 21 is formed in a box-like shape whose lower side is opened. Around a lower end of an outer circumference of the lid 32, an upper side flange 37 is provided. The upper side flange 37 is fixed to the lower side flange 36 of the storage 31. Thereby, the lid 32 is integrated with the storage 31. An inner space of the lid 32 is communicated with an inner space of the storage 31.

The duct 33 of the case main body 21 is formed in a cylindrical shape extending along the left-and-right direction. The duct 33 is integratedly formed with the storage 31. An inner space of the duct 33 is communicated with the inner space of the storage 31. In a lower face of the duct 33, a discharge port 38 through which the toner is discharged is provided.

With reference to FIG. 3, the agitator 22 of the toner container 15 is stored in the storage 31 of the case main body 21. The agitator 22 is rotatable around a first rotation axis X extending along the left-and-right direction. That is, the left-and-right direction is a rotation axis direction of the agitator 22 in the present embodiment. The agitator 22 includes an agitating shaft 40 extending along the left-and-right direction and an agitating blade 41 mounted to the agitating shaft 40. The agitating blade 41 is made of resin film, for example, and formed in a sheet-like shape.

A portion between a left end portion and a center portion in the left-and-right direction of the conveyer 23 of the toner container 15 is stored in the storage 31 of the case main body 21. Aright side portion of the conveyer 23 is stored in the duct 33 of the case main body 21. A right end portion of the conveyer 23 is protruded to the right side (the outside in the left-and-right direction) further than the duct 33, and exposed to an outside of the case main body 21. The conveyer 23 is rotatable around a second rotation axis Y extending along the left-and-right direction. That is, the left-and-right direction is a rotation axis direction of the conveyer 23 in the present embodiment.

The conveyer 23 includes a conveying shaft 43 extending along the left-and-right direction, a spiral conveying fin 44 protruding on an outer circumference of the conveying shaft 43 and a driven gear 45 fixed to the right end portion (the portion exposed to the outside of the case main body 21) of the conveying shaft 43.

Figure 4:
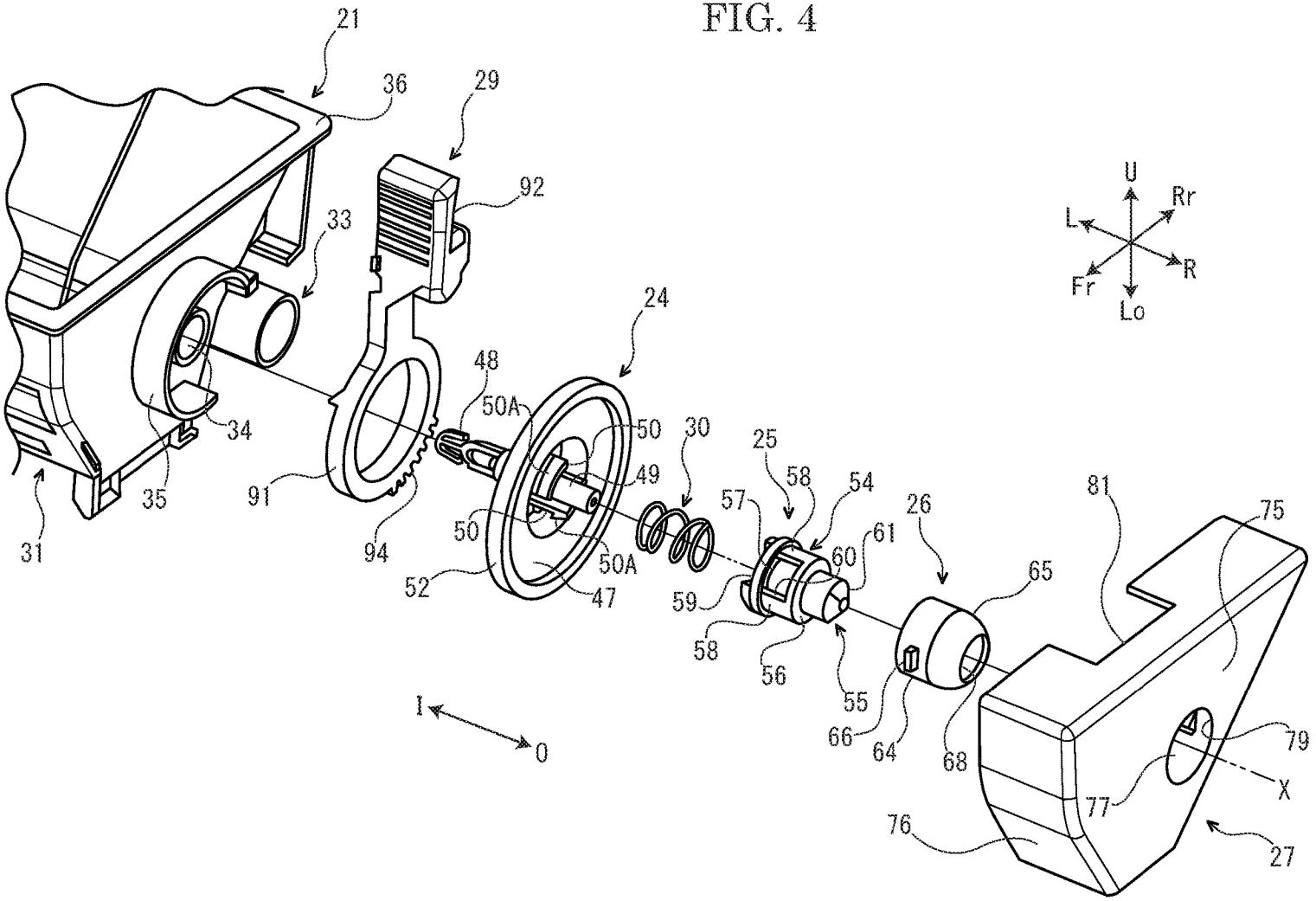
FIG. 4 is a disassembled perspective view showing the toner container according to the first embodiment of the present disclosure, when viewed from a right front side.
Figure 5:
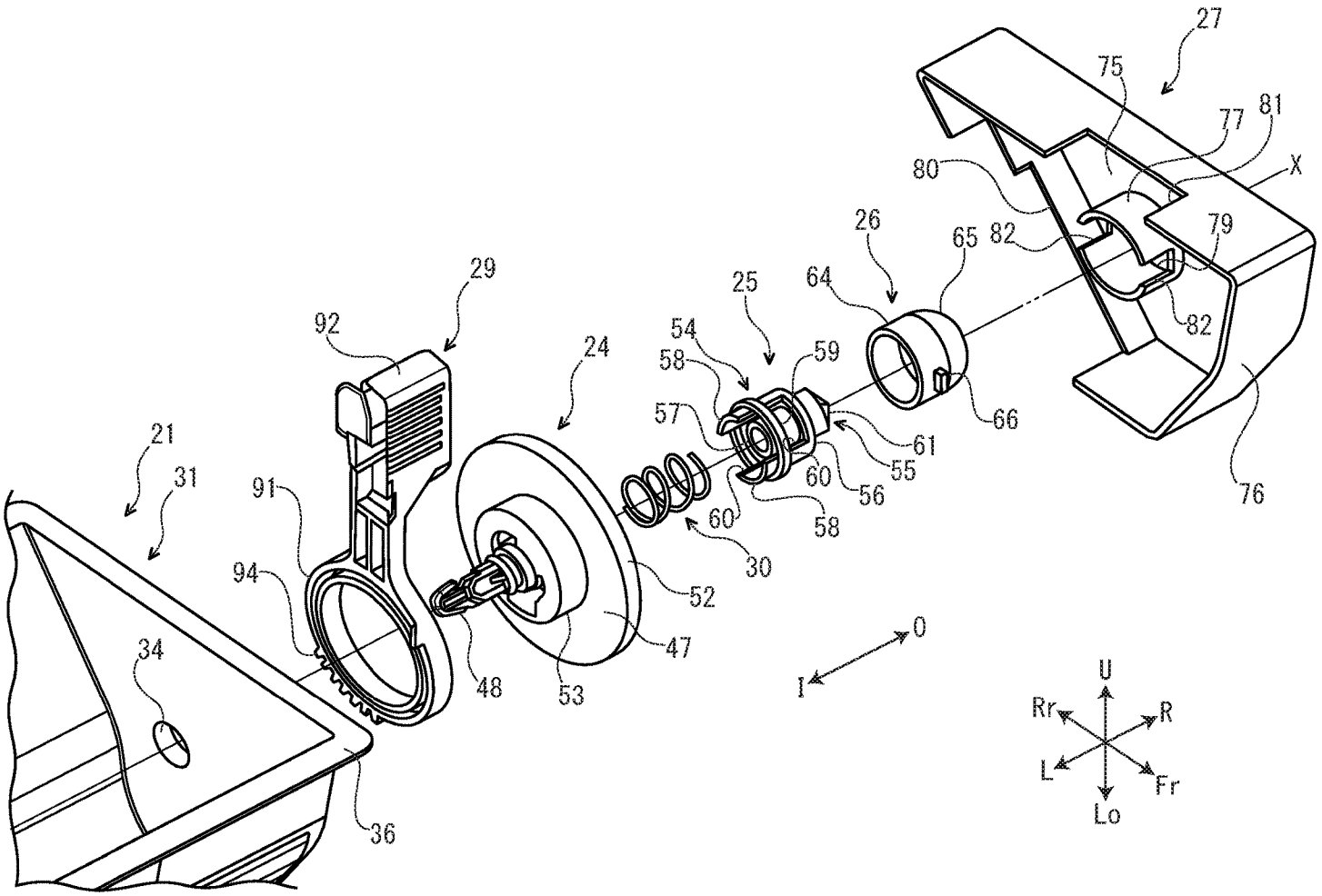
FIG. 5 is a disassembled perspective view showing the toner container according to the first embodiment of the present disclosure, when viewed from a left front side.

With reference to FIG. 4 and FIG. 5, the supporter 24 of the toner container 15 includes an annular base piece 47, a coupling piece 48 protruding from a center portion of the base piece 47 to the left side (the inside in the left-and-right direction), a boss piece 49 protruding from the center portion of the base piece 47 to the right side (the outside in the left-and-right direction) and a pair of inserted pieces 50 protruding from the base piece 47 at an outer circumference of the boss piece 49 to the right side (the outside in the left-and-right direction).

With reference to FIG. 3, the base piece 47 of the supporter 24 is arranged at the right side (the outside in the left-and-right direction) of the storage 31 of the case main body 21. That is, the base piece 47 is arranged outside the case main body 21. Around an outer circumferential face of the base piece 47, a driving gear 52 is provided. The driving gear 52 is meshed with the driven gear 45 of the conveyer 23. Thereby, the supporter 24 is connected to the conveyer 23. On a left face (a face at the inside in the left-and-right direction) of the base piece 47, a pedestal 53 is protruded.

The coupling piece 48 of the supporter 24 penetrates through the supporting hole 34 provided in the right side wall 31R of the storage 31 of the case main body 21. Thereby, the supporter 24 is rotatably supported by the case main body 21. A tip end portion of the coupling piece 48 is inserted into an inside of the storage 31, and fixed to a right end portion of the agitating shaft 40 of the agitator 22. Thereby, the supporter 24 is connected to the agitator 22, and rotatable integrally with the agitator 22 around the first rotation axis X.

With reference to FIG. 4, on a right end portion (an end portion at the outside in the left-and-right direction) of each inserted piece 50 of the supporter 24, a hook 50A is provided. The hook 50A is protruded to an outside in a radial direction (a direction separated from the first rotation axis X).

With reference to FIG. 6 to FIG. 10, the transmitter 25 of the toner container 15 is arranged at the right side (the outside in the left-and-right direction) of the storage 31 of the case main body 21. That is, the transmitter 25 is arranged outside the case main body 21. The transmitter 25 moves linearly along the left-and-right direction between a first position (refer to FIG. 7 and FIG. 9), a second position (refer to FIG. 6 and FIG. 10) which is arranged at the right side (the outside in the left-and-right direction) of the first position and a third position (refer to FIG. 8) which is arranged at the left side (the inside in the left-and-right direction) of the first position.

The transmitter 25 includes an inside part 54 and an outside part 55 protruding from the inside part 54 to the right side (the outside in the left-and-right direction). The inside part 54 is covered with the cover 27 in a state where the transmitter 25 is in the second position (refer to FIG. 6 and FIG. 10). The outside part 55 is protruded to the right side (the outside in the left-and-right direction) further than the cover 27 in the state where the transmitter 25 is in the second position.

With reference to FIG. 4 and FIG. 5, the inside part 54 of the transmitter 25 includes a transmitting piece 56, a cylindrical piece 57 protruding from a center portion of the transmitting piece 56 to the left side (the inside in the left-and-right direction), a pair of protruding pieces 58 protruding from the transmitting piece 56 at an outer circumference of the cylindrical piece 57 to the left side (the inside in the left-and-right direction) and an approximate annular fixing piece 59 fixed to outer circumferential faces of left side portions of the pair of protruding pieces 58. Into the cylindrical piece 57, the boss piece 49 of the supporter 24 is inserted. A pair of inserting grooves 60 is formed between the pair of protruding pieces 58. Into each inserting groove 60, each inserted piece 50 of the supporter 24 is inserted. According to the configuration described above, the transmitter 25 is supported by the supporter 24 in a state where the transmitter 25 is movable along the left-and-right direction and is not rotatable with respect to the supporter 24. The fixing piece 59 engagingly locks the hook 50A of each inserted piece 50. This inhibits removal of each inserted piece 50 from each inserting groove 60.

On a right face (a face at the outside in the left-and-right direction) of the outside part 55 of the transmitter 25, a transmitting coupling 61 is provided. The transmitting coupling 61 is formed in an approximate square pyramid-like shape. The transmitting coupling 61 has a different shape for every type (for example, a destination, a color of the toner or a model of the printer 1) of the toner container 15. That is, the toner container 15 having a type different from the toner container 15 of the present embodiment includes the transmitting coupling 61 having a shape different from the present embodiment (for example, an approximate trigonal pyramid-like shape or an approximate pentagonal pyramid-like shape).

With reference to FIG. 6 to FIG. 10, the mover 26 of the toner container 15 is arranged at the right side (the outside in the left-and-right direction) of the storage 31 of the case main body 21. That is, the mover 26 is arranged outside the case main body 21. The mover 26 moves linearly along the left-and-right direction between a first moved position (refer to FIG. 7 to FIG. 9) and a second moved position (refer to FIG. 6 and FIG. 10) which is arranged at the right side (the outside in the left-and-right direction) of the first moved position.

With reference to FIG. 4 and FIG. 5, the mover 26 includes an inside cylindrical part 64, an outside cylindrical part 65 extending from the inside cylindrical part 64 to the right side (the outside in the left-and-right direction) and projection parts 66 protruding from both front and rear side portions of the inside cylindrical part 64 to an outside in a radial direction (a direction separated from the first rotation axis X).

Figure 6:
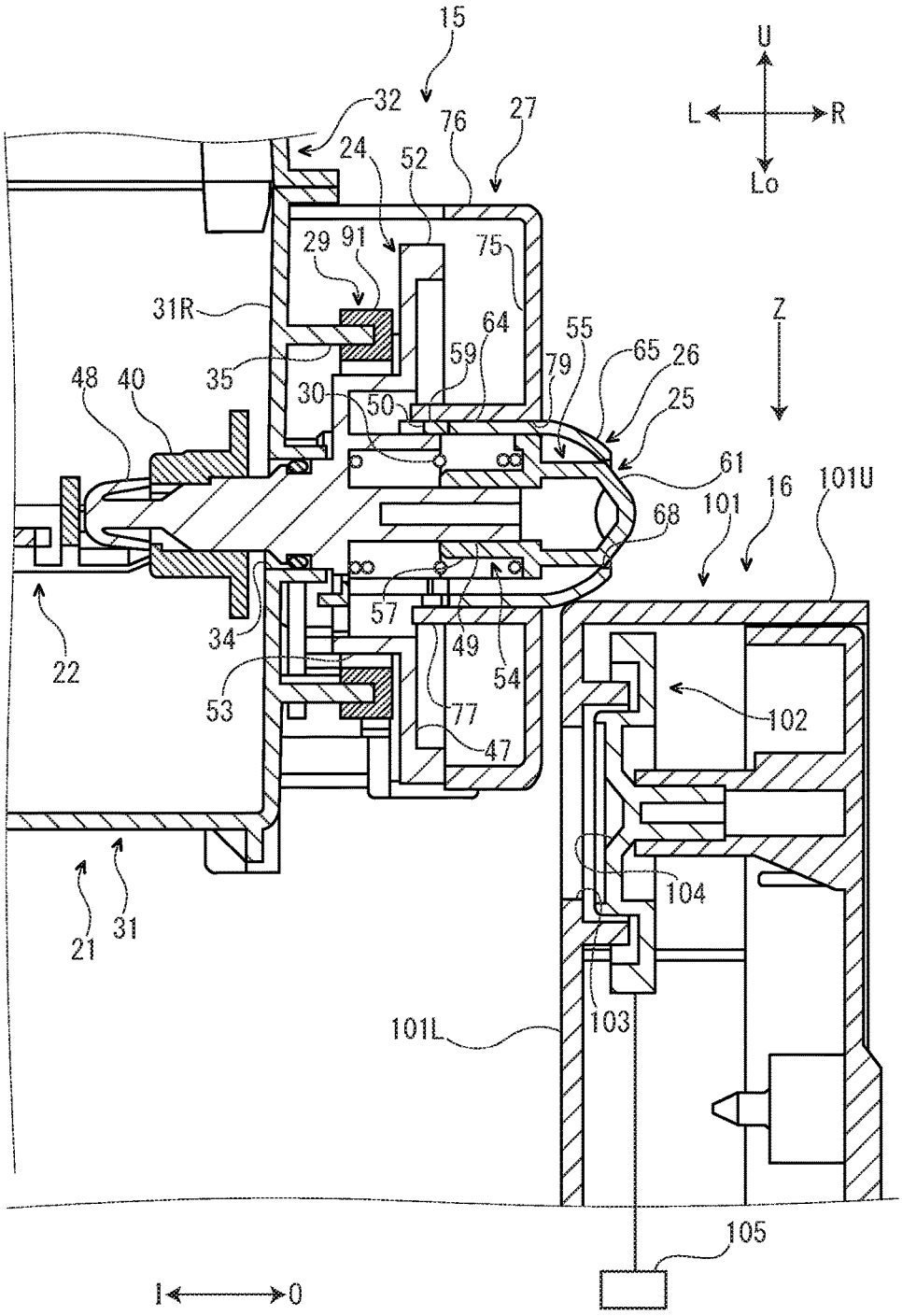
FIG. 6 is a sectional view showing a state where the toner container is inserted to a predetermined position in the attachment part, in the printer according to the first embodiment of the present disclosure.

The inside cylindrical part 64 of the mover 26 is formed in a cylindrical shape with the first rotation axis X as an axis center. With reference to FIG. 6 and the others, the inside cylindrical part 64 covers an outer circumference of a right side portion (a portion at the outside in the left-and-right direction) of the inside part 54 of the transmitter 25. A left edge portion (an edge portion at the inside in the left-and-right direction) of the inside cylindrical part 64 comes into contact with the fixing piece 59 of the inside part 54.

With reference to FIG. 4 and FIG. 5, the outside cylindrical part 65 of the mover 26 is formed in a cylindrical shape with the first rotation axis X as an axis center. An outer circumferential face of the outside cylindrical part 65 is formed in a spherical belt-like shape, and inclined toward the right side (the outside in the left-and-right direction) so as to approach the first rotation axis X. With reference to FIG. 6 and the others, the outside cylindrical part 65 covers an outer circumference of a left side portion (a portion at the inside in the left-and-right direction) of the outside part 55 of the transmitter 25. In a right end portion (an end portion at the outside in the left-and-right direction) of the outside cylindrical part 65, an opening 68 is provided.

With reference to FIG. 4 and FIG. 5, the cover 27 of the toner container 15 includes a plate-shaped main wall 75, a circumferential wall 76 arranged at an outer circumference side of the main wall 75 and a guide wall 77 arranged at a center side of the main wall 75.

The main wall 75 of the cover 27 is provided along a plane crossing the first rotation axis X. In a center portion of the main wall 75, a circular through hole 79 is provided.

The circumferential wall 76 of the cover 27 is formed in a rectangular cylindrical shape. The circumferential wall 76 is protruded from an outer circumference of the main wall 75 toward the left side (the inside in the left-and-right direction). In a rear portion of the circumferential wall 76, an exposing groove 80 is provided. Through the exposing groove 80, a part of the driving gear 52 of the supporter 24 is exposed to an outside of the cover 27. In an upper portion of the circumferential wall 76, a notch 81 is provided.

The guide wall 77 of the cover 27 is formed in a cylindrical shape. The guide wall 77 is protruded from the main wall 75 at an outer circumference of the through hole 79 toward the left side (the inside in the left-and-right direction). Into the guide wall 77, the inside cylindrical part 64 of the mover 26 is inserted. The guide wall 77 has a pair of slits 82 extending along the left-and-right direction. With each slit 82, each projection part 66 of the mover 26 is engaged. According to the above described configuration, the cover 27 supports the mover 26 so as to be movable along the left-and-right direction.

Figure 11:
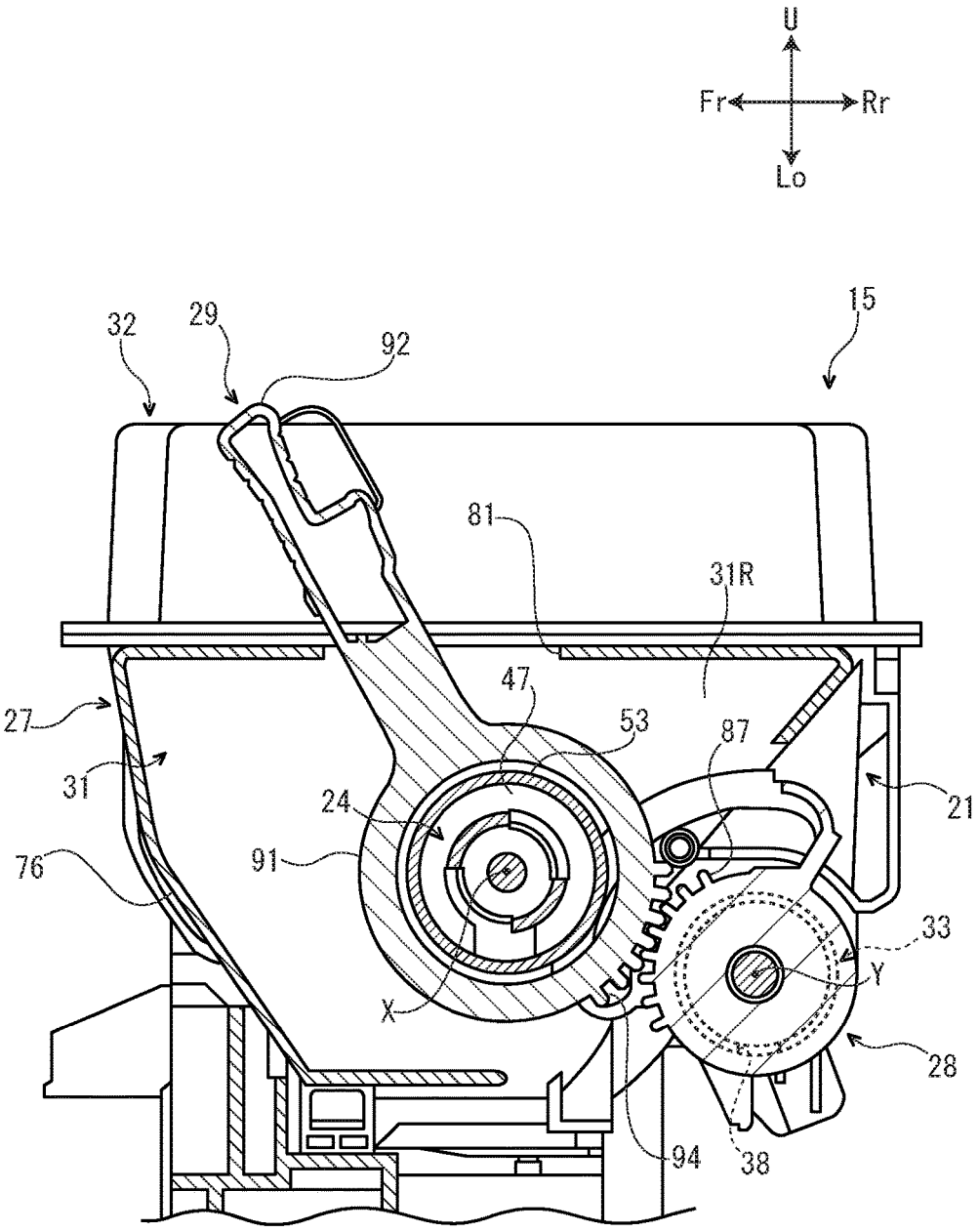
FIG. 11 is a sectional view showing a state where a manipulation member is in a first manipulating position and a shutter is in a closing position, in the toner container according to the first embodiment of the present disclosure.
Figure 12:
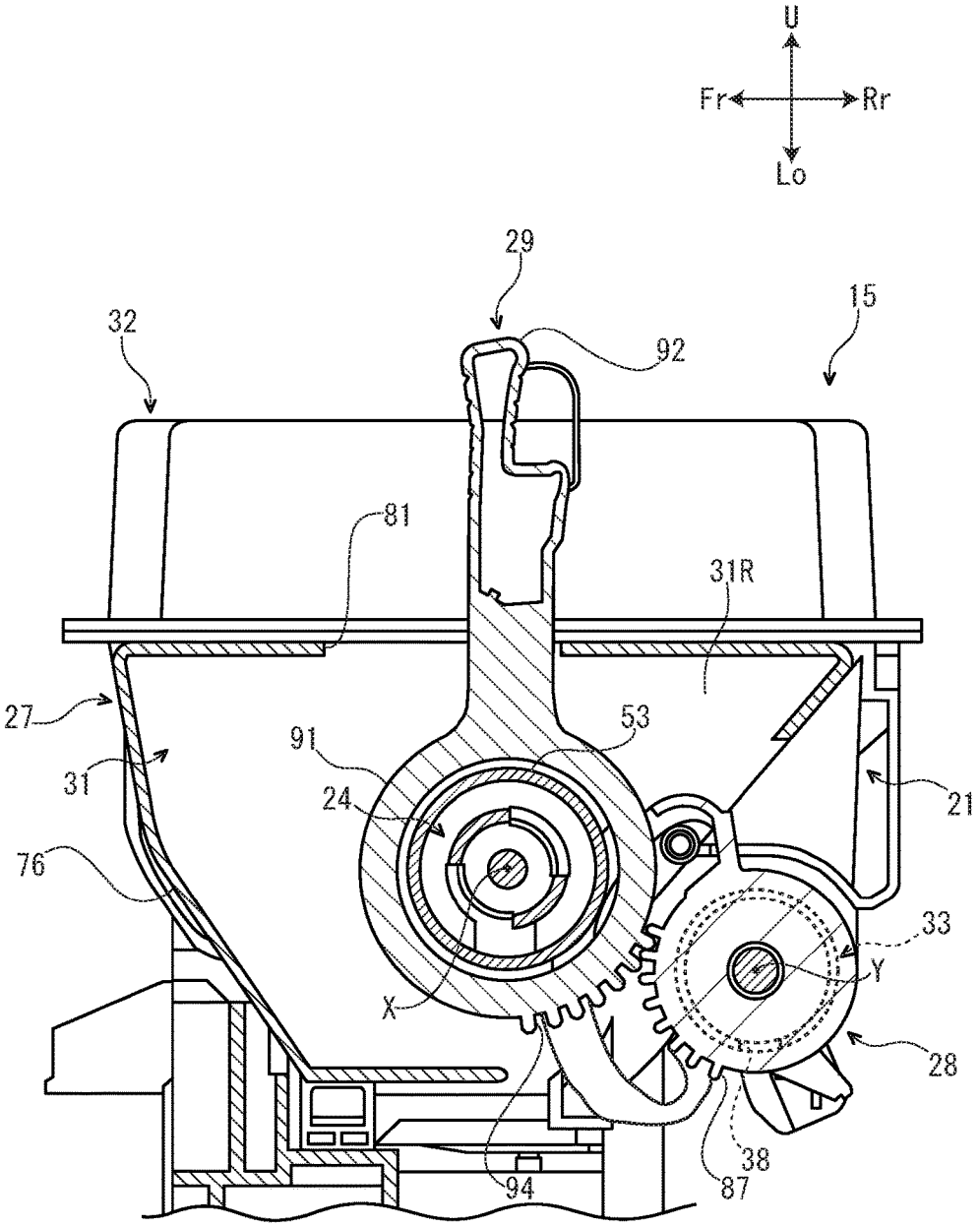
FIG. 12 is a sectional view showing a state where the manipulation member is in a second manipulating position and the shutter is in an opening position, in the toner container according to the first embodiment of the present disclosure.

With reference to FIG. 11 and FIG. 12, the shutter 28 of the toner container 15 is formed in an approximate cylindrical shape. The shutter 28 is rotatably attached to an outer circumference of the duct 33 of the case main body 21. The shutter 28 is rotatable between a closing position (refer to FIG. 11) where the shutter 28 closes the toner discharge port 38 provided in the duct 33 and an opening position (refer to FIG. 12) where the shutter 28 opens the toner discharge port 38. Around an outer circumferential face of the shutter 28, a shutter side gear 87 is provided.

The manipulation member 29 of the toner container 15 is arranged at the right side (the outside in the left-and-right direction) of the storage 31 of the case main body 21. That is, the manipulation member 29 is arranged outside the case main body 21. The manipulation member 29 is rotatable around the first rotation axis X between a first manipulating position (refer to FIG. 11) and a second manipulating position (refer to FIG. 12).

With reference to FIG. 4 and FIG. 5, the manipulation member 29 includes a main part 91 and a manipulated part 92 extending linearly from an outer circumferential face of the main part 91 to an outside in a radial direction (to a side separated from the first rotation axis X).

Figure 13:
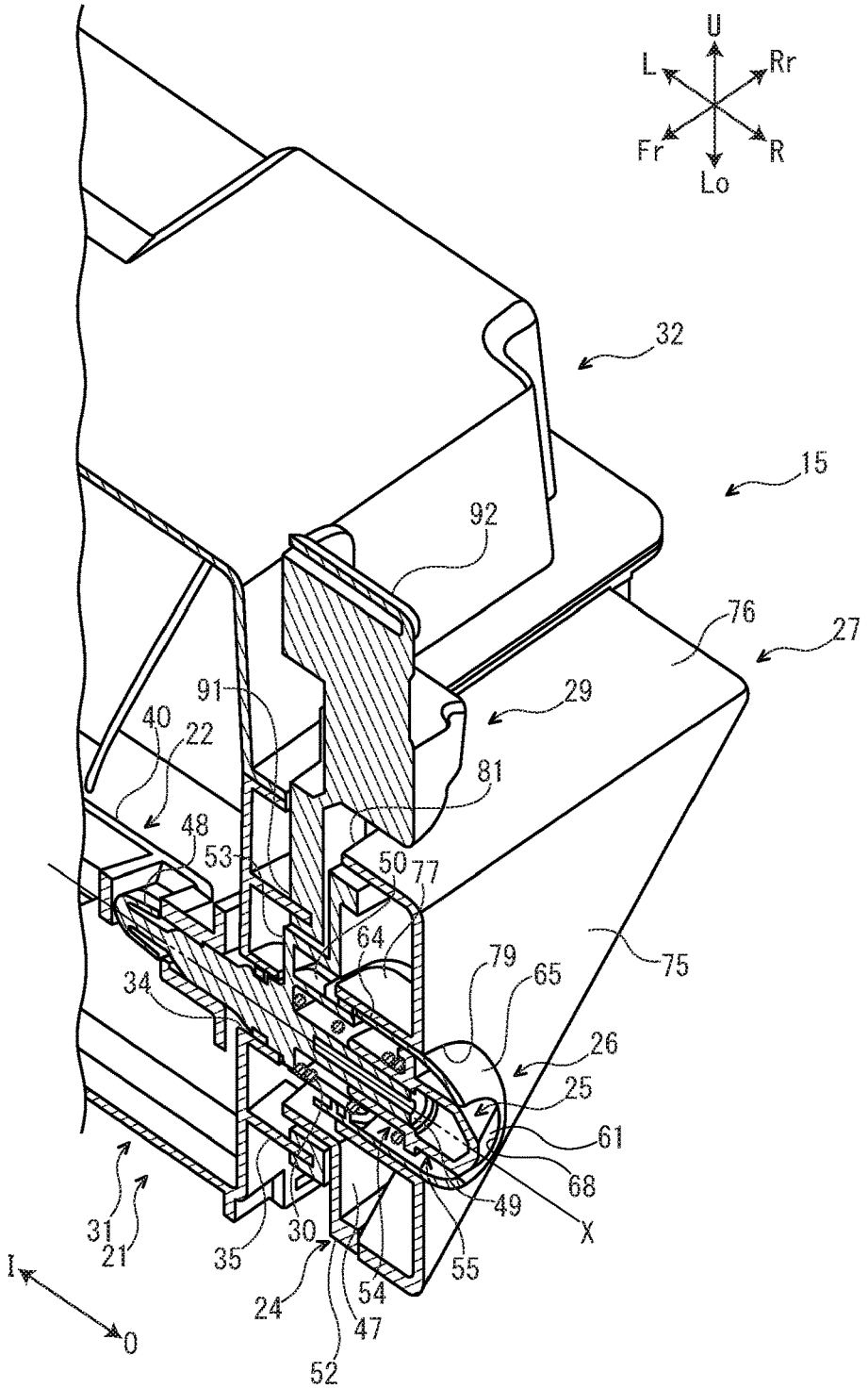
FIG. 13 is a sectional view showing the right side portion of the toner container according to the first embodiment of the present disclosure.

The main part 91 of the manipulation member 29 is formed in an annular shape with the first rotation axis X as a center. With reference to FIG. 13, the main part 91 is rotatably attached to an outer circumference of the pedestal 53 of the base piece 47 of the supporter 24. Thereby, the main part 91 is rotatably supported by the supporting rib 35 of the storage 31 of the case main body 21. With reference to FIG. 11 and FIG. 12, on a rear lower portion of an outer circumferential face of the main part 91, a manipulation member side gear 94 is provided. The manipulation member side gear 94 is meshed with the shutter side gear 87 of the shutter 28. Thereby, the manipulation member 29 is connected to the shutter 28.

The manipulated part 92 of the manipulation member 29 is manipulated by a worker, such as a user or a serviceman, when the manipulation member 29 is rotated. An upper portion of the manipulated part 92 is exposed to an upper side of the cover 27 through the notch 81 of the circumferential wall 76 of the cover 27.

With reference to FIG. 6 and the others, the coil spring 30 of the toner container 15 is interposed between the base piece 47 of the supporter 24 and the inside part 54 of the transmitter 25. The coil spring 30 is attached to an outer circumference of the cylindrical piece 57 of the inside part 54. The coil spring 30 presses the transmitter 25 toward the right side (the outside in the left-and-right direction) to bias the transmitter 25 to the second position (refer to FIG. 6 and FIG. 10) and to bias the mover 26 to the second moved position (refer to FIG. 6 and FIG. 10).

Next, the attachment part 16 will be described in detail.

Figure 14:
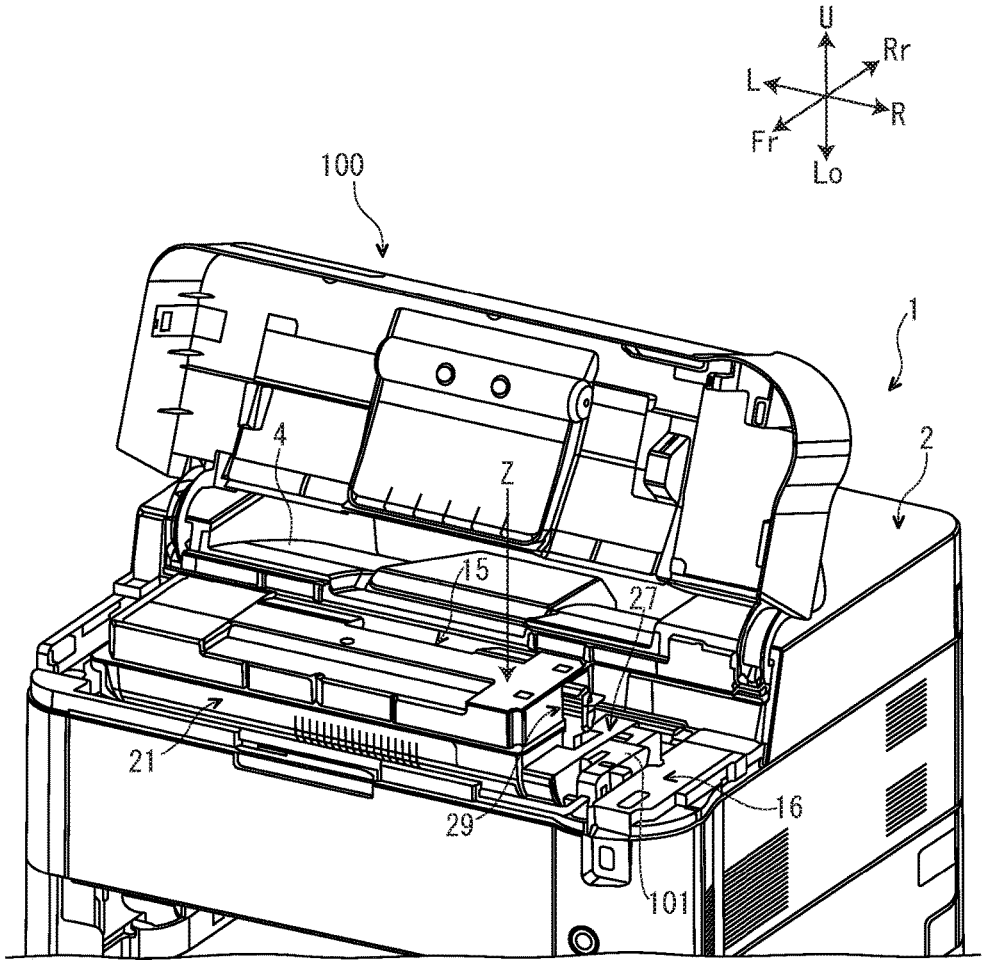
FIG. 14 is a perspective view showing a state where a top cover is opened, in the printer according to the first embodiment of the present disclosure.

With reference to FIG. 14, an upper side of the attachment part 16 is covered with an openable and closable top cover 100. By opening the top cover 100, it becomes possible to attach and detach the toner container 15 to and from the attachment part 16. To the attachment part 16, the toner container 15 is detachably attached along an attachment direction Z from the upper side to the lower side.

With reference to FIG. 6 and the others, the attachment part 16 includes a case 101 and a driving piece 102 stored in an upper portion of the case 101.

The case 101 of the attachment part 16 is arranged at a right end side of the attachment part 16. In an upper portion of a left side wall 101L of the case 101, a circular coupling hole 103 is provided.

The driving piece 102 of the attachment part 16 is rotatably supported by the case 101. The driving piece 102 is connected to a driving source 105 constituted by a motor and the others. On a left face (an inner face) of the driving piece 102, a driving coupling 104 is provided. The driving coupling 104 is exposed to an outside of the case 101 through the coupling hole 103 of the case 101. The driving coupling 104 has a different shape for every type (for example, a destination, a color of the toner or a model of the printer 1) of the attachment part 16. That is, the attachment part 16 having a type different from the attachment part 16 of the present embodiment includes the driving coupling 104 having a shape different from the present embodiment (for example, an approximate triangle-pyramid shape or a pentagonal-pyramid shape).

Next, an operation to discharge the toner from the toner container 15 will be described.

With reference to FIG. 3, when the toner is discharged from the toner container 15, in a state where the transmitting coupling 61 of the transmitter 25 is coupled to the driving coupling 104 of the driving piece 102 and the toner discharge port 38 provided in the duct 33 is opened, the driving source 105 is driven. When the driving source 105 is driven, the driving piece 102 is rotated by rotation driving force from the driving source 105, and the driving coupling 104 provided in the driving piece 102 is rotated. When the driving coupling 104 is thus rotated, rotation of the driving coupling 104 is transmitted to the agitator 22 by the transmitter 25 and the supporter 24, and the agitator 22 is rotated.

As a result, the toner stored in the storage 31 of the case main body 21 is agitated by the agitator 22.

When the driving coupling 104 is rotated as described above, the rotation is transmitted to the conveyer 23 by the transmitter 25 and the supporter 24, and the conveyer 23 is rotated. As a result, as shown by an arrow A in FIG. 3, the toner stored in the storage 31 and the duct 33 of the case main body 21 is conveyed toward the toner discharge port 38 by the conveyer 23. The toner thus conveyed toward the toner discharge port 38 is discharged through the toner discharge port 38 to the outside of the toner container 15. The toner discharged to the outside of the toner container 15 is replenished to the developing device 10 (refer to FIG. 1).

Next, an operation to set the toner container 15 to the attachment part 16 by a worker, such as a user and a serviceman, will be described.

In a state where the toner container 15 is detached from the attachment part 16, as shown in FIG. 13, the mover 26 is arranged in the second moved position by biasing force of the coil spring 30 and the transmitter 25 is arranged in the second position. Additionally, as shown in FIG. 11, the manipulation member 29 is arranged in the first manipulating position and the shutter 28 is arranged in the closing position.

When the worker sets the toner container 15 to the attachment part 16, as shown in FIG. 2, the worker inserts the toner container 15 to the attachment part 16 along the attachment direction Z.

As shown in FIG. 6, when the toner container 15 is inserted to a predetermined position with respect to the attachment part 16, the outer circumferential face of the outside cylindrical part 65 of the mover 26 comes into contact with a boundary portion between the left side wall 101L and an upper wall 101U of the case 101.

Figure 7:
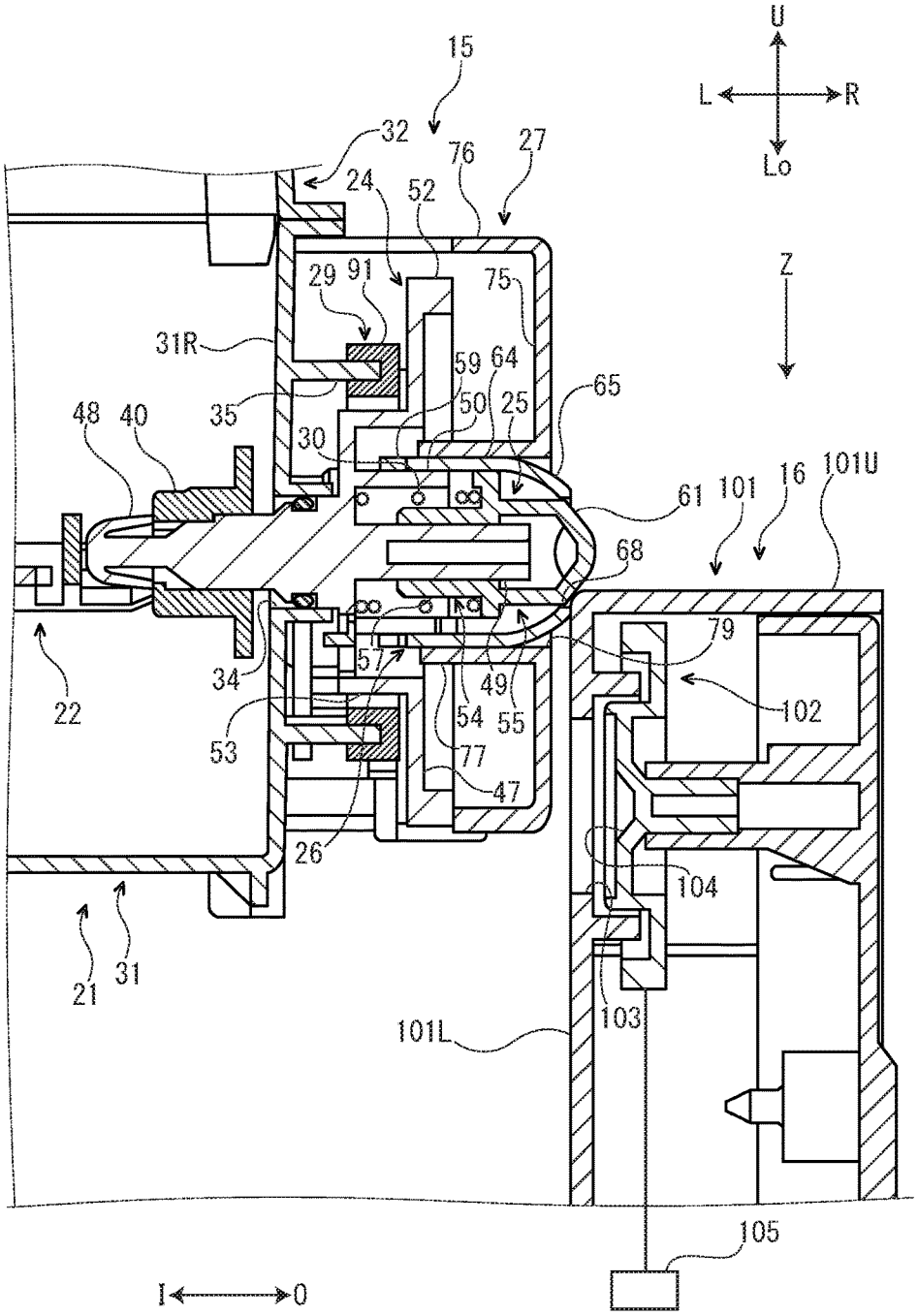
FIG. 7 is a sectional view showing a state where the toner container is further inserted to a downstream side in an attachment direction with respect to the attachment part from the state shown in FIG. 6, in the printer according to the first embodiment of the present disclosure.

From this state, when the toner container 15 is further inserted to the lower side (a downstream side in the attachment direction Z) with respect to the attachment part 16, the case 101 presses the outer circumferential face of the outside cylindrical part 65 of the mover 26. The pressing moves the mover 26 from the second moved position to the first moved position against the biasing force of the coil spring 30, as shown in FIG. 7. Consequently, the inside cylindrical part 64 of the mover 26 presses the fixing piece 59 of the transmitter 25, and the transmitter 25 moves from the second position to the first position against the biasing force of the coil spring 30. Meanwhile, an outer circumferential face of the transmitting coupling 61 of the transmitter 25 comes into contact with the boundary portion between the left side wall 101L and the upper wall 101U of the case 101.

Figure 8:
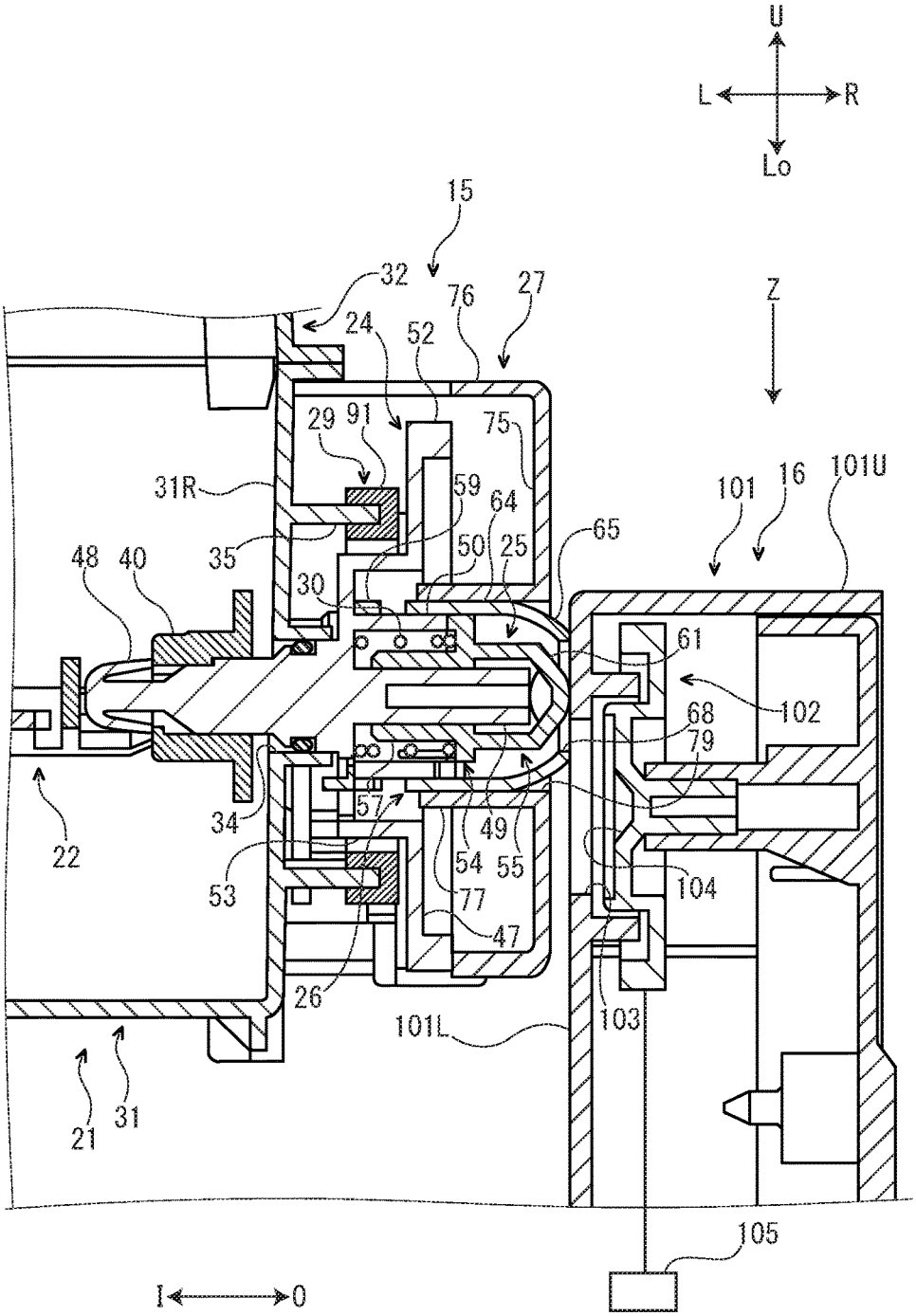
FIG. 8 is a sectional view showing a state where the toner container is further inserted to the downstream side in the attachment direction with respect to the attachment part from the state shown in FIG. 7, in the printer according to the first embodiment of the present disclosure.

From this state, when the toner container 15 is further inserted to the lower side (the downstream side in the attachment direction Z) with respect to the attachment part 16, the case 101 presses the outer circumferential face of the transmitting coupling 61 of the transmitter 25. The pressing moves the transmitter 25 from the first position to the third position against pressing force of the coil spring 30 in a state where the mover 26 is in the first moved position, as shown in FIG. 8.

Figure 9:
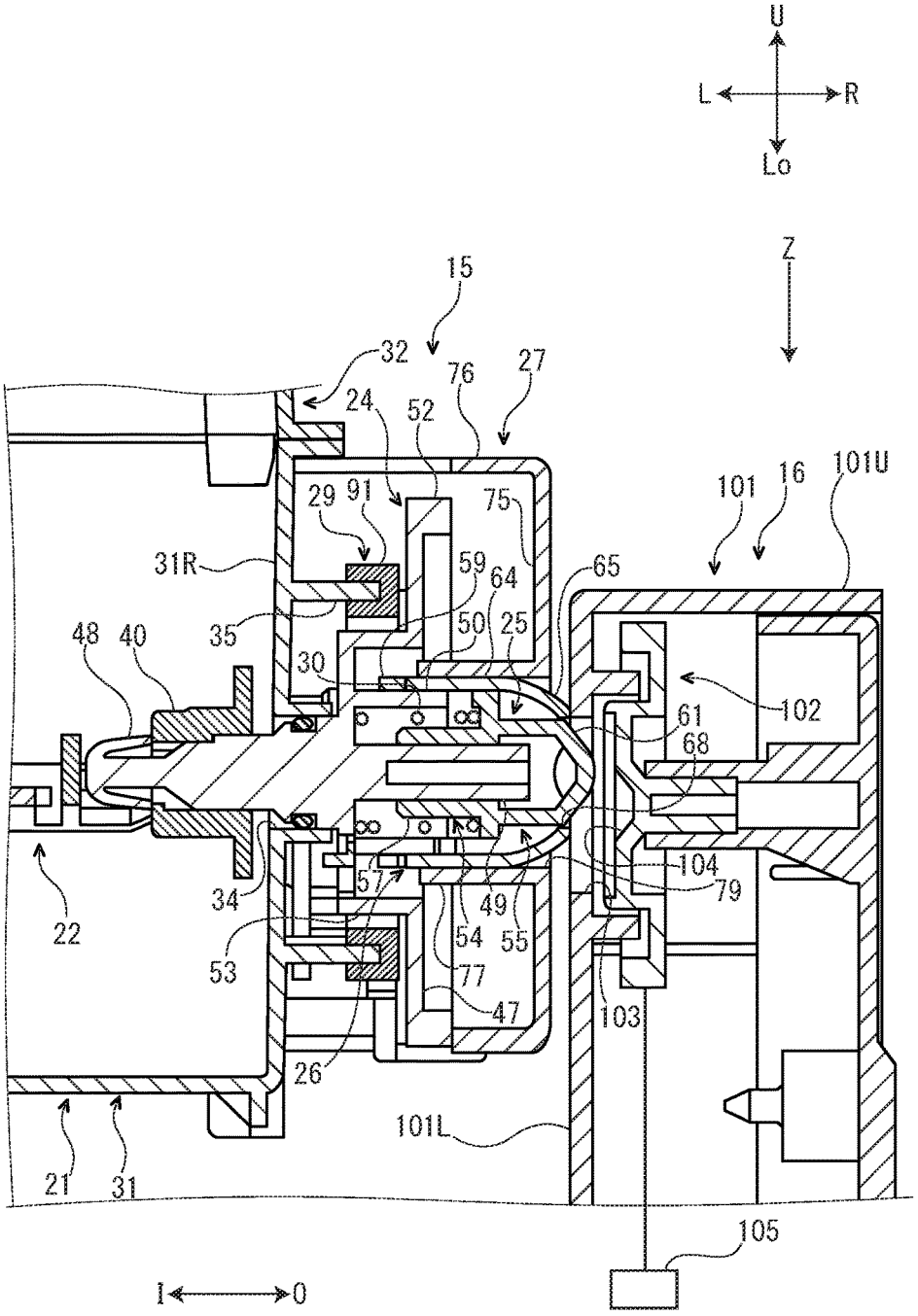
FIG. 9 is a sectional view showing a state where the toner container is further inserted to the downstream side in the attachment direction with respect to the attachment part from the state shown in FIG. 8, in the printer according to the first embodiment of the present disclosure.

From this state, when the toner container 15 is further inserted to the lower side (the downstream side in the attachment direction Z) with respect to the attachment part 16, the pressing of the transmitter 25 to the third position by the case 101 is released. When the pressing is released, as shown in FIG. 9, in the state where the mover 26 is in the first moved position, the transmitter 25 moves from the third position to the first position by the pressing force of the coil spring 30.

Figure 10:
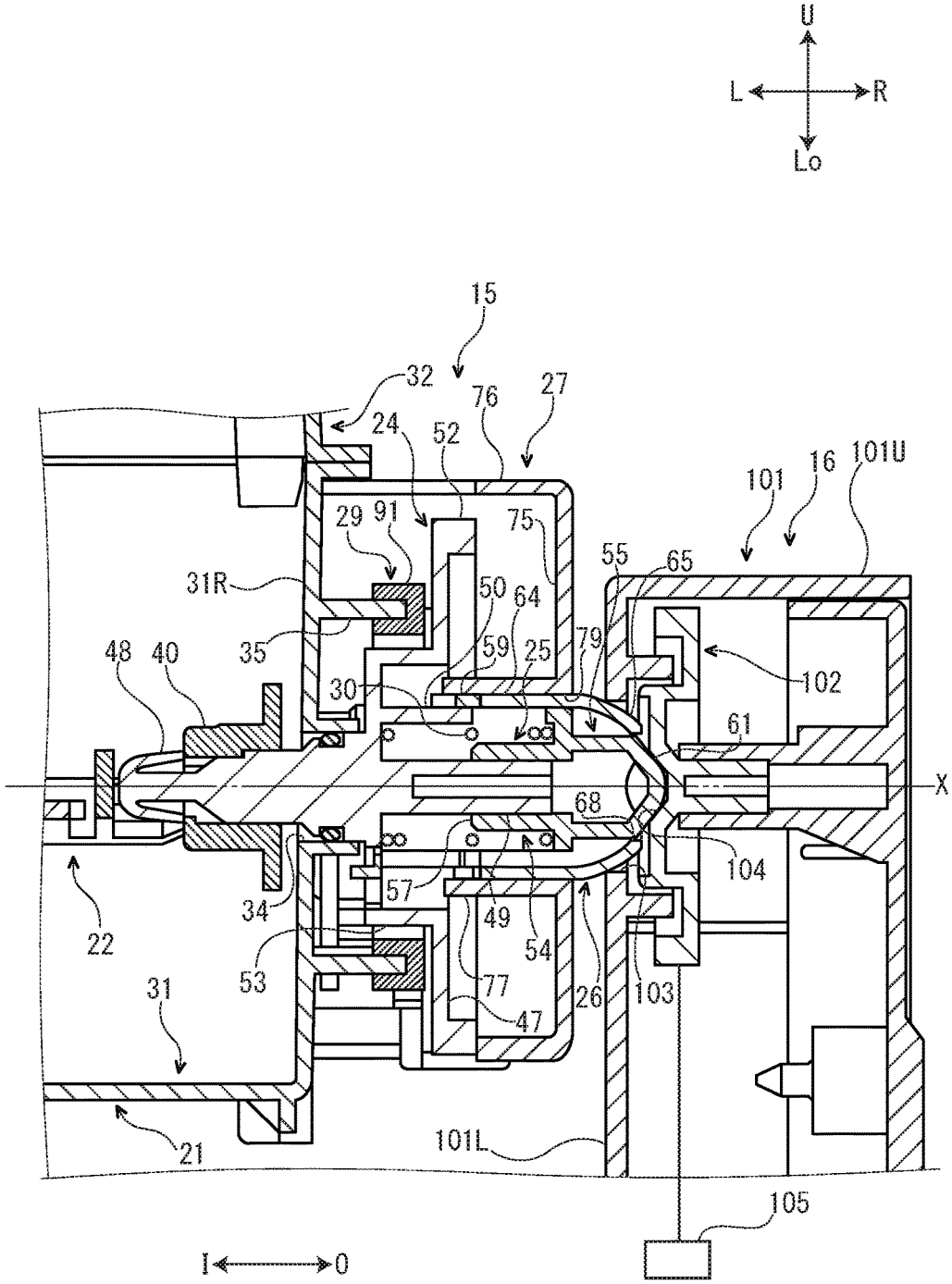
FIG. 10 is a sectional view showing a state where the toner container is attached to the attachment part, in the toner container according to the first embodiment of the present disclosure.

From this state, when the toner container 15 is further inserted to the lower side (the downstream side in the attachment direction Z) with respect to the attachment part 16, the toner container 15 is attached to the attachment part 16. When the toner container 15 is thus attached to the attachment part 16, as shown in FIG. 10, the outside cylindrical part 65 of the mover 26 is engaged with the coupling hole 103 of the case 101. Consequently, the pressing of the mover 26 to the first moved position by the case 101 is released, and the mover 26 moves from the first moved position to the second moved position by the biasing force of the coil spring 30. As a result, the transmitter 25 moves from the first position to the second position by the biasing force of the coil spring 30, and the transmitting coupling 61 is coupled to the driving coupling 104.

Next, the worker manipulates the manipulated part 92 of the manipulation member 29 to the rear side, and rotates the manipulation member 29 from the first manipulating position (refer to FIG. 11) to the second manipulating position (refer to FIG. 12). Consequently, rotation of the manipulation member 29 is transmitted to the shutter 28, and the shutter 28 rotates from the closing position (refer to FIG. 11) to the opening position (refer to FIG. 12). As a result, the toner discharge port 38 is opened. Thereby, the setting of the toner container 15 to the attachment part 16 is completed.

When the toner container 15 is attached to the attachment part 16 as described above, if the type of the toner container 15 matches the type of the attachment part 16, the shape of the transmitting coupling 61 matches the shape of the driving coupling 104, and coupling of the transmitting coupling 61 to the driving coupling 104 is therefore permitted. As a result, transmitting of the rotation from the driving coupling 104 to the transmitting coupling 61 is permitted. On the other hand, if the type of the toner container 15 does not match the type of the attachment part 16, the shape of the transmitting coupling 61 does not match the shape of the driving coupling 104, and the coupling of the transmitting coupling 61 to the driving coupling 104 is therefore restricted. As a result, the transmitting of the rotation from the driving coupling 104 to the transmitting coupling 61 is restricted. By applying such a configuration, it becomes possible to restrict an incompatible toner container 15 from being incorrectly attached to the attachment part 16.

When the worker detaches the toner container 15 from the attachment part 16, the worker manipulates the manipulated part 92 of the manipulation member 29 to the front side, and rotates the manipulation member 29 from the second manipulating position (refer to FIG. 12) to the first manipulating position (refer to FIG. 11). Consequently, the rotation of the manipulation member 29 is transmitted to the shutter 28, and the shutter 28 rotates from the opening position (refer to FIG. 12) to the closing position (refer to FIG. 11). As a result, the toner discharge port 38 is closed.

Next, the worker pulls out the toner container 15 from the attachment part 16 along a direction opposing to the attachment direction Z. Thereby, the toner container 15 is detached from the attachment part 16.

In the present embodiment, as described above, as the mover 26 moves from the second moved position to the first moved position, the transmitter 25 moves from the second position to the first position, and as the mover 26 moves from the first moved position to the second moved position, the transmitter 25 moves from the first position to the second position. By applying such a configuration, when the case 101 presses the mover 26, it becomes possible to move the transmitter 25 between the first position and the second position without directly pressing the transmitter 25 by the case 101. Accordingly, it becomes possible to move the transmitter 25 along the left-and-right direction while suppressing the transmitter 25 from being damaged.

In the present embodiment, after the mover 26 starts to contact with the case 101, the transmitting coupling 61 of the transmitter 25 starts to contact with the case 101. By applying such a configuration, it becomes possible to reduce impact produced when the transmitting coupling 61 starts to contact with the case 101 compared with a case where the transmitting coupling 61 starts to contact with the case 101 suddenly. Accordingly, it becomes possible to easily suppress the transmitting coupling 61 from being damaged.

Additionally, the mover 26 includes the inside cylindrical part 64 covering the outer circumference of the inside part 54 of the transmitter 25 and the outside cylindrical part 65 extending from the inside cylindrical part 64 to the right side (the outside in the left-and-right direction) and covering the outer circumference of the outside part 55 of the transmitter 25. By applying such a configuration, it becomes possible to suppress the outside part 55 of the transmitter 25 from being damaged.

Additionally, the outer circumferential face of the outside cylindrical part 65 is formed in a spherical belt-like shape. By applying such a configuration, when the case 101 presses the outer circumferential face of the outside cylindrical part 65, it becomes possible to move the mover 26 from the second moved position to the first moved position surely.

Additionally, as the mover 26 moves from the first moved position to the second moved position, the transmitter 25 moves from the first position to the second position by the biasing force of the coil spring 30. By applying such a configuration, it becomes possible to move the transmitter 25 from the first position to the second position surely.

Additionally, the transmitter 25 moves along the left-and-right direction between the first position and the third position, in the state where the mover 26 is in the first moved position. By applying such a configuration, if impact is applied to the transmitter 25 in the state where the mover 26 is in the first moved position, the transmitter 25 moves from the first position to the third position so that it becomes possible to absorb the applied impact. Accordingly, it becomes possible to suppress the transmitter 25 from being damaged more surely.

Additionally, as the manipulation member 29 is manipulated, the shutter 28 opens and closes the toner discharge port 38. By applying such a configuration, it becomes possible to open and close the toner discharge port 38 without complicating a structure of the attachment part 16.

Additionally, the printer 1 includes the toner container 15 and the attachment part 16 to which the toner container 15 is detachably attached. By applying such a configuration, it becomes possible to replace the toner container 15 easily.

By the way, in some cases, with the attaching operation of the toner container 15 to the attachment part 16, the driving coupling 104 is moved to couple the driving coupling 104 to the transmitting coupling 61. However, if such a configuration is applied, the attachment part 16 needs a driving mechanism to move the driving coupling 104, and therefore, the attachment part 16 is complicated in its structure.

On the contrary, in the present embodiment, in a middle of attaching of the toner container 15 to the attachment part 16, the case 101 presses the mover 26, the mover 26 moves from the second moved position to the first moved position, and the transmitter 25 moves from the second position to the first position. Then, when the toner container 15 is attached to the attachment part 16, the pressing of the mover 26 to the first moved position by the case 101 is released, the mover 26 moves from the first moved position to the second moved position, the transmitter 25 moves from the first position to the second position, and the transmitting coupling 61 is coupled to the driving coupling 104. By applying such a configuration, the attachment part 16 eliminates the need for the driving mechanism to move the driving coupling 104. Accordingly, it becomes possible to inhibit the complication of the structure of the attachment part 16 and to achieve space saving of the attachment part 16.

In the present embodiment, the shutter 28 is rotatably attached to the outer circumference of the duct 33 of the case main body 2. On the other hand, in another embodiment, the shutter 28 may be rotatably attached to an inner circumference of the duct 33 of the case main body 21.

In the present embodiment, an entire part of the agitator 22 is stored in the case main body 21. On the other hand, in another embodiment, a part of the agitator 22 may be stored in the case main body 21. In the present embodiment, the conveyer 23 except the right end portion is stored in the case main body 21. On the other hand, in another embodiment, an entire part of the conveyer 23 may be stored in the case main body 21.

In the present embodiment, an entire part of the transmitter 25 is arranged outside the case main body 21. On the other hand, in another embodiment, apart of the transmitter 25 may be arranged outside the case main body 21.

In the present embodiment, the configuration of the present disclosure is applied to the printer 1. On the other hand, in still another embodiment, the configuration of the present disclosure may be applied to an image forming apparatus, such as a copying machine, a facsimile and a multifunctional peripheral (an image forming apparatus including multiple functions, such as printing function, copying function and facsimile function), other than the printer 1.

A Second Embodiment

Hereinafter, a second embodiment of the present disclosure will be described with reference to FIG. 15 to FIG. 20. The description overlapped with the first embodiment is suitably omitted.

Firstly, a toner container 111 according to the second embodiment will be described. In the following description and FIG. 15 to FIG. 20, the same parts as the toner container 15 according to the first embodiment are shown by the same reference numbers as the toner container 15 according to the first embodiment.

Figure 15:
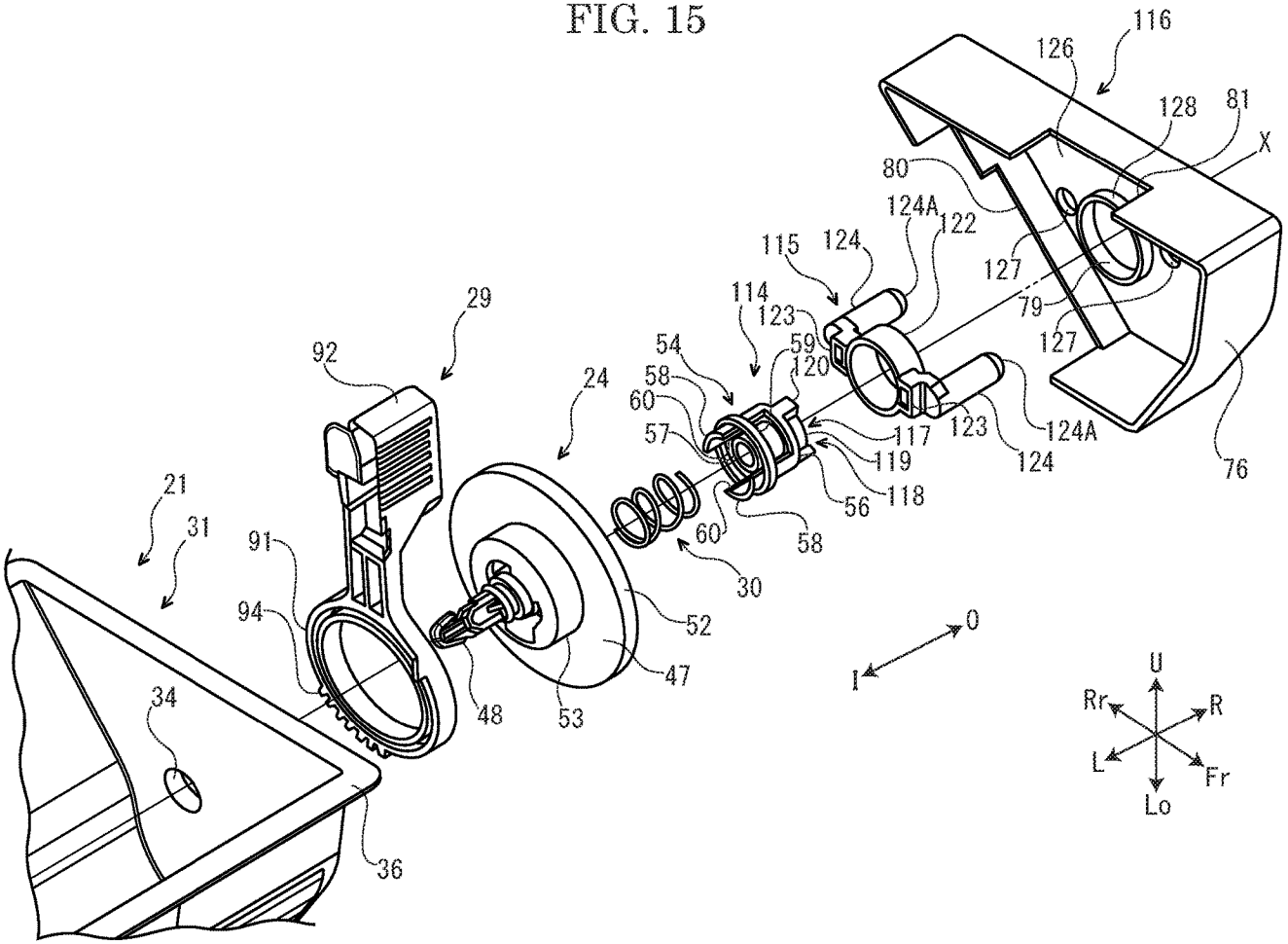
FIG. 15 is a disassembled perspective view showing a toner container according to a second embodiment of the present disclosure, when viewed from a left front side.
Figure 16:
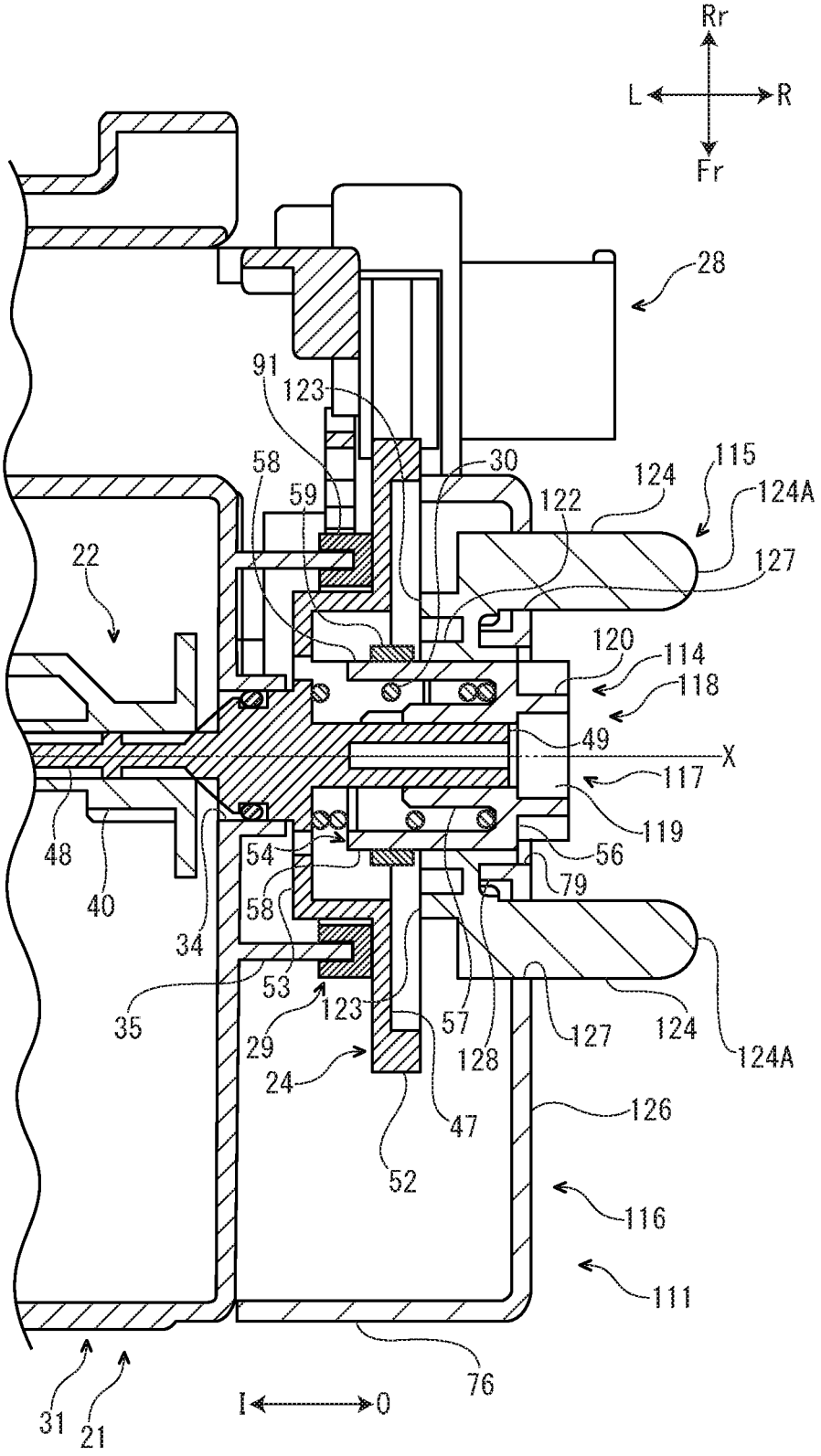
FIG. 16 is a sectional view showing a right side portion of the toner container according to the second embodiment of the present disclosure.
Figure 17:
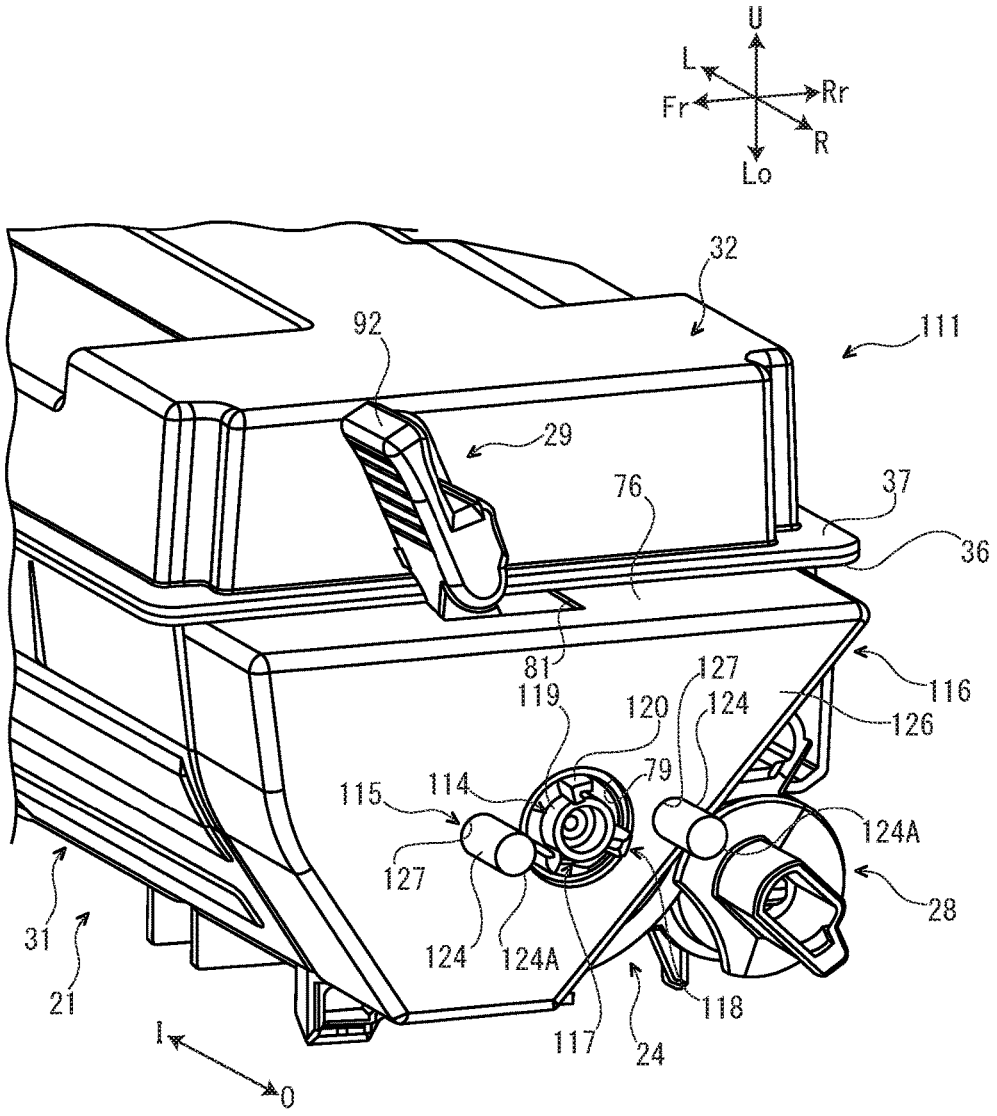
FIG. 17 is a perspective view showing the right side portion of the toner container according to the second embodiment of the present disclosure.

With reference to FIG. 15 and FIG. 16, a transmitter 114 of the toner container 111 includes the inside part 54 and an outside part 117 protruding from the inside part 54 to the right side (the outside in the left-and-right direction). On a right face (a face at the outside in the left-and-right direction) of the outside part 117, a transmitting coupling 118 is provided. With reference to FIG. 17, the transmitting coupling 118 includes a cylindrical transmitting cylinder 119 and three transmitting projections 120 protruding on an outer circumferential face of the transmitting cylinder 119.

With reference to FIG. 15 and FIG. 16, a mover 115 of the toner container 111 includes a cylindrical part 122, a pair of arm parts 123 extending from both front and rear side portions of the cylindrical part 122 to an outside in a radial direction and a pair of boss parts 124 extending from the pair of arm parts 123 to the right side (the outside in the left-and-right direction). The cylindrical part 122 is formed in a cylindrical shape with the first rotation axis X as an axis center. The cylindrical part 122 covers the outer circumference of the right side portion (the portion at the outside in the left-and-right direction) of the inside part 54 of the transmitter 114. The cylindrical part 122 does not cover an outer circumference of the outside part 117 of the transmitter 114. Each boss part 124 extends along the left-and-right direction. A right end portion 124A (an end portion at the outside in the left-and-right direction) of each boss part 124 is formed in a hemispherical shape.

A cover 116 of the toner container 111 includes a plate-shaped main wall 126, the circumferential wall 76 arranged at an outer circumference side of the main wall 126 and a guide wall 128 arranged at a center side of the main wall 126. The main wall 126 has hole parts 127 at both front and rear sides of the through hole 79. Through each hole part 127, each boss part 124 of the mover 115 is penetrated. Thereby, the right end portion 124A (the end portion at the outside in the left-and-right direction) of each boss part 124 is protruded to the right side (the outside in the left-and-right direction) further than the cover 116. The guide wall 128 does not have the slit (refer to the first embodiment).

Next, an attachment part 112 according to the second embodiment will be described. In the specification and attached drawings, the same parts as the attachment part 16 according to the first embodiment are shown by the same reference numbers as the attachment part 16 according to the first embodiment.

Figure 18:
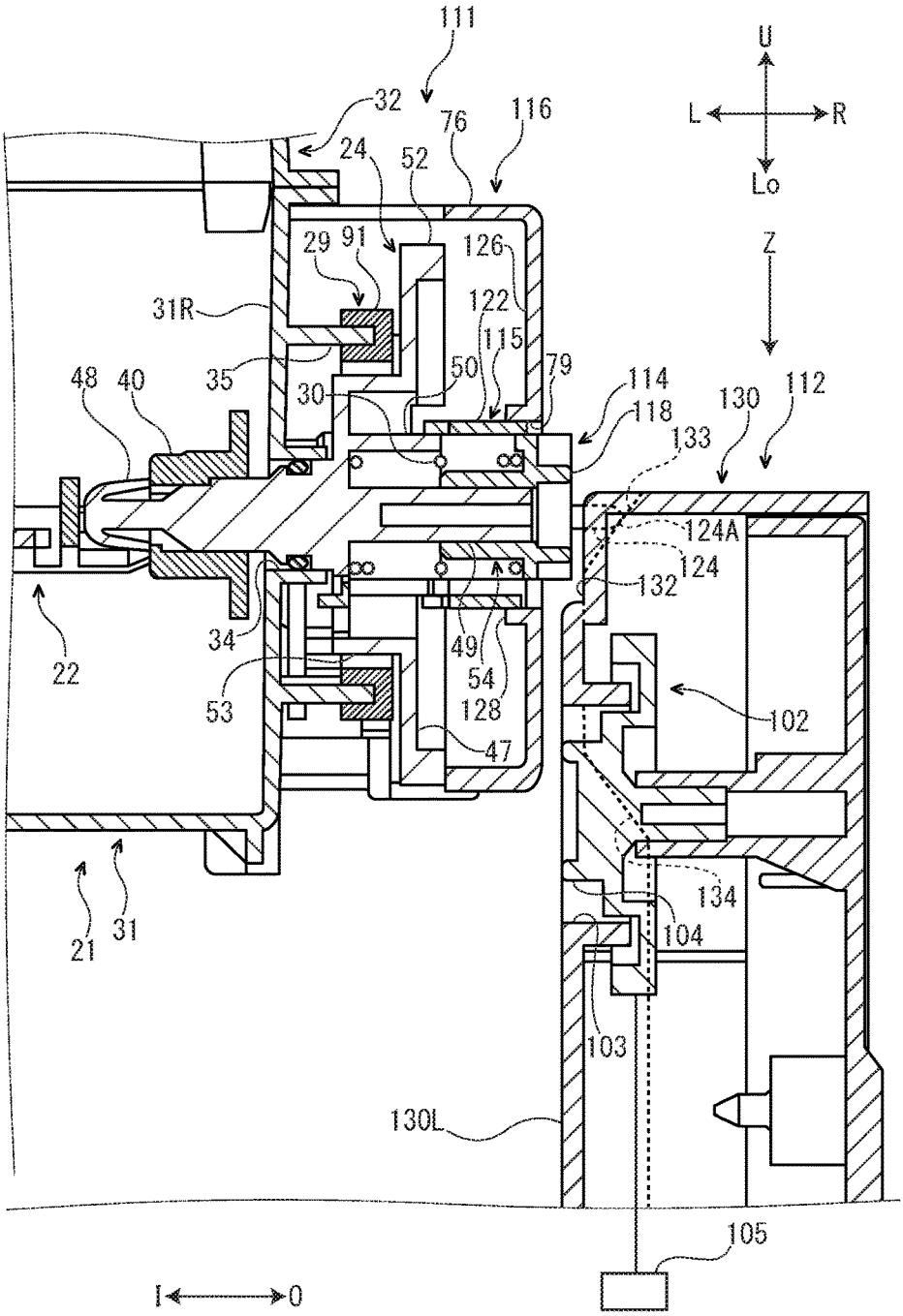
FIG. 18 is a sectional view showing a state where the toner container is inserted to a predetermined position in an attachment part, in the printer according to the second embodiment of the present disclosure.

With reference to FIG. 18 and the others, in a left side wall 130L of a case 130 of the attachment part 112, a recess 132 is provided above the coupling hole 103. In the left side wall 130L of the case 130 of the attachment part 112, upstream side inclined parts 133 are provided at both front and rear sides of the recess 132. Each upstream side inclined part 133 is inclined to the left side (the inside in the left-and-right direction) toward the lower side (the downstream side in the attachment direction Z). In the left side wall 130L of the case 130 of the attachment part 112, a downstream side inclined part 134 is provided at the lower side (the downstream side in the attachment direction Z) of each upstream side inclined part 133. Each downstream side inclined part 134 is inclined to the right side (the outside in the left-and-right direction) toward the lower side (the downstream side in the attachment direction Z).

Next, an operation to set the toner container 111 to the attachment part 112 by a worker, such as a user or a serviceman, will be described.

When the worker sets the toner container 111 to the attachment part 112, the worker inserts the toner container 111 to the attachment part 112 along the attachment direction Z. As shown in FIG. 18, when the toner container 111 is inserted to a predetermined position with respect to the attachment part 112, the right end portion 124A of each boss part 124 of the mover 115 comes into contact with each upper side inclined part 133 of the case 130.

Figure 19:
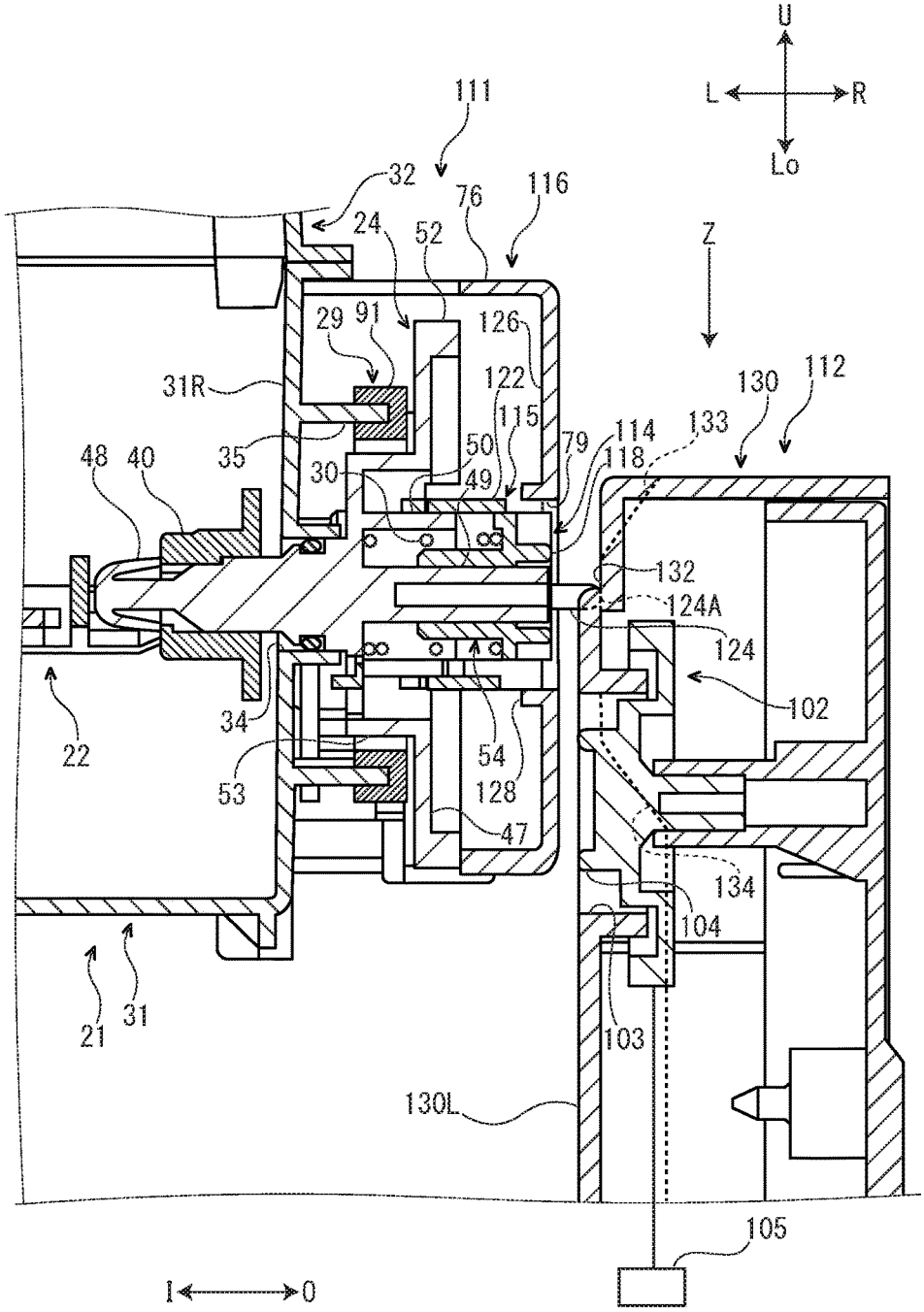
FIG. 19 is a sectional view showing a state where the toner container is further inserted to a downstream side in an attachment direction with respect to the attachment part from the state shown in FIG. 18, in the printer according to the second embodiment of the present disclosure.

From this state, when the toner container 111 is further inserted to the lower side (the downstream side in the attachment direction Z) with respect to the attachment part 112, the case 130 presses the right end portion 124A of each boss part 124 of the mover 115. The pressing moves the mover 115 from the second moved position to the first moved position against the biasing force of the coil spring 30, as shown in FIG. 19. Consequently, the mover 115 presses the transmitter 114, and the transmitter 114 moves from the second position to the first position against the biasing force of the coil spring 30.

Figure 20:
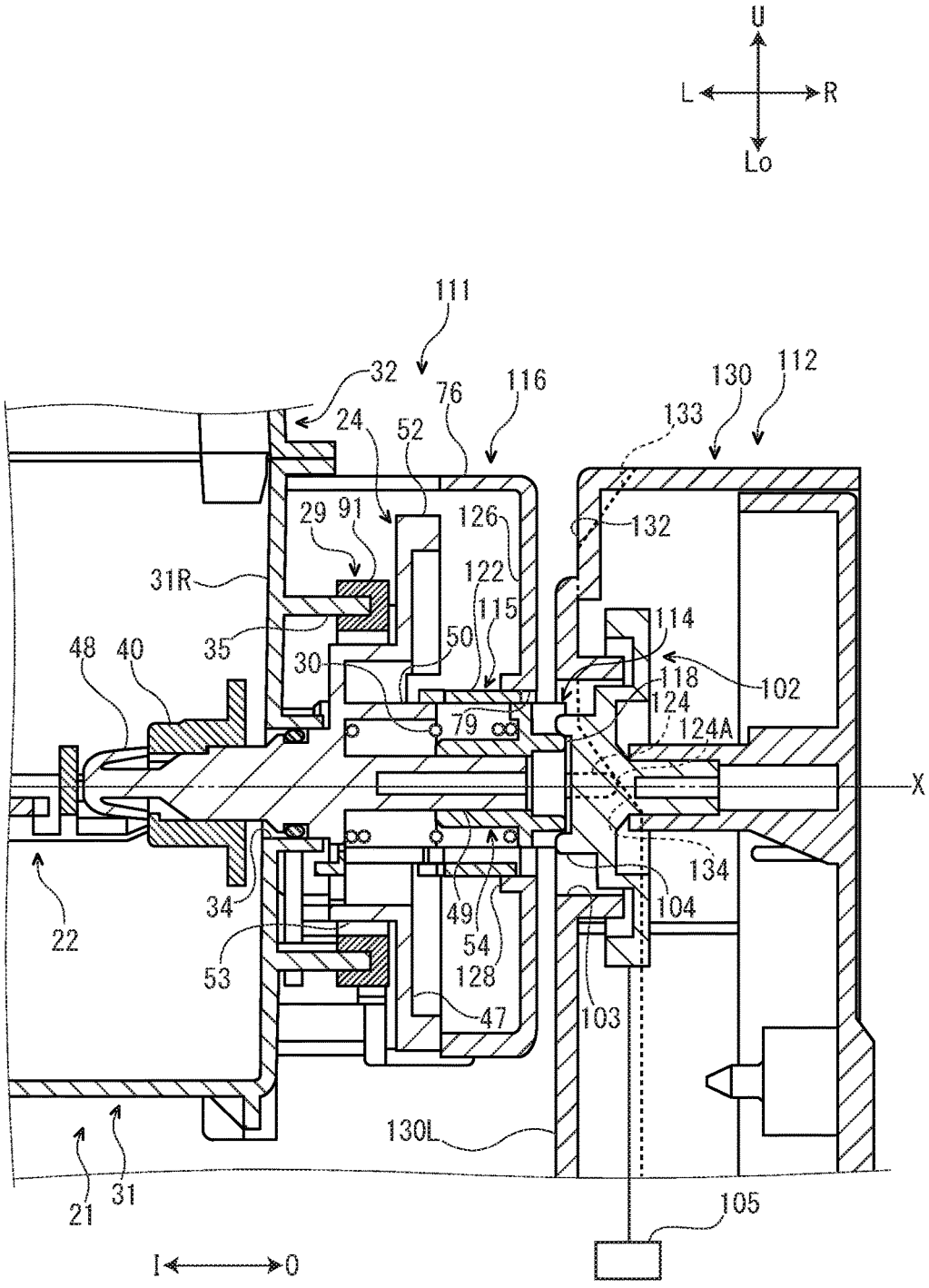
FIG. 20 is a sectional view showing a state where the toner container is attached to the attachment part, in the printer according to the second embodiment of the present disclosure.

From this state, when the toner container 111 is further inserted to the lower side (the downstream side in the attachment direction Z) with respect to the attachment part 112, the toner container 111 is attached to the attachment part 112. When the toner container 111 is thus attached to the attachment part 112, as shown in FIG. 20, the right end portion 124A of each boss part 124 of the mover 115 comes into contact with each downstream side inclined part 134 of the case 130. Meanwhile, the pressing of the mover 115 to the first moved position by the case 130 is released, and the mover 115 moves from the first moved position to the second moved position by the biasing force of the coil spring 30. As a result, the transmitter 114 moves from the first position to the second position by the biasing force of the coil spring 30, and the transmitting coupling 118 is coupled to the driving coupling 104.

Next, as the same process as the first embodiment, the worker manipulates the manipulated part 92 of the manipulation member 29 (refer to FIG. 17 and the others) to rotate the manipulation member 29, and makes the shutter 28 open the toner discharge port 38. Thereby, the setting of the toner container 111 to the attachment part 112 is completed.

When the worker detaches the toner container 111 from the attachment part 112, the worker manipulates the manipulated part 92 of the manipulation member 29 to the front side to rotate the manipulation member 29, and makes the shutter 28 close the toner discharge port 38. Next, the worker pulls out the toner container 111 from the attachment part 112 along a direction opposing to the attachment direction Z. Thereby, the toner container 111 is detached from the attachment part 112.

The mover 115 of the present embodiment includes the cylindrical part 122 covering the outer circumference of the inside part 54 of the transmitter 114, the pair of arm parts 123 extending from the cylindrical part 122 to the outside in the radial direction and the pair of boss parts 124 extending from the pair of arm parts 123 to the right side (the outside in the left-and-right direction). The right end portion 124A (the end portion at the outside in the left-and-right direction) of each boss part 124 is protruded to the right side (the outside in the left-and-right direction) further than the cover 116. By applying such a configuration, the right end portion 124A of each boss part 124 arranged at interval from the outside part 117 of the transmitter 114 is allowed to be pressed by the case 130. Accordingly, it becomes possible to improve degree of freedom in a shape of the transmitting coupling 118 provided in the outside part 117 of the transmitter 114.

Additionally, the right end portion 124A (the end portion at the outside in the left-and-right direction) of each boss part 124 is formed in a hemispherical shape. By applying such a configuration, when the case 130 presses the right end portion 124A of each boss part 124, it becomes possible to move the mover 115 from the second moved position to the first moved position surely.

A Third Embodiment

Hereinafter, a third embodiment of the present disclosure will be described with reference to the FIG. 21 to FIG. 23. The description overlapped with the first embodiment is suitably omitted.

Firstly, a toner container 141 according to the third embodiment will be described. In the following description and FIG. 21 to FIG. 23, the same parts as the toner container 15 according to the first embodiment are shown by the same reference numbers as the toner container 15 according to the first embodiment.

Figure 21:
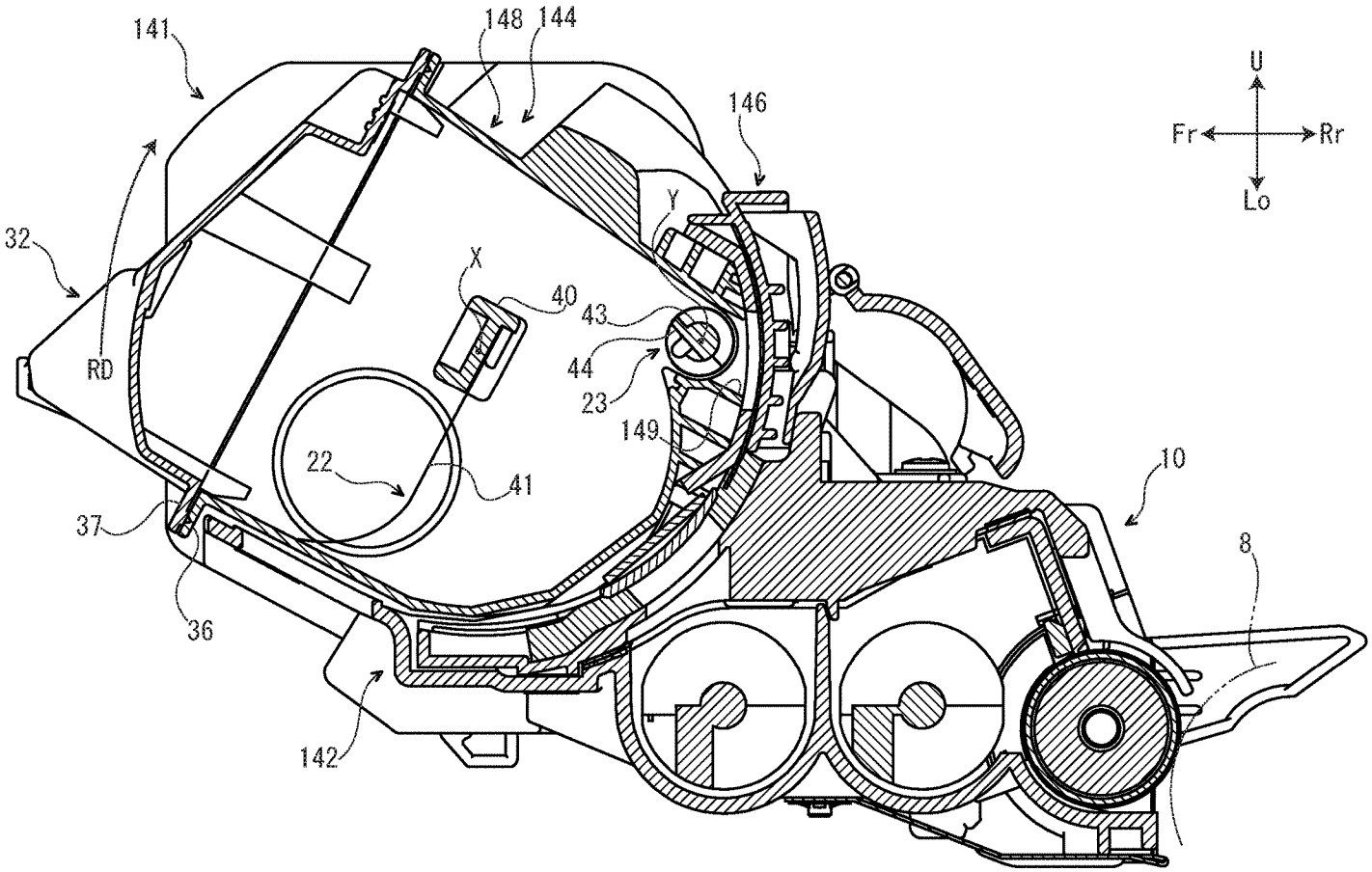
FIG. 21 is a sectional view showing a state where a case main body is in a first rotated position, in a printer according to a third embodiment of the present disclosure.
Figure 22:
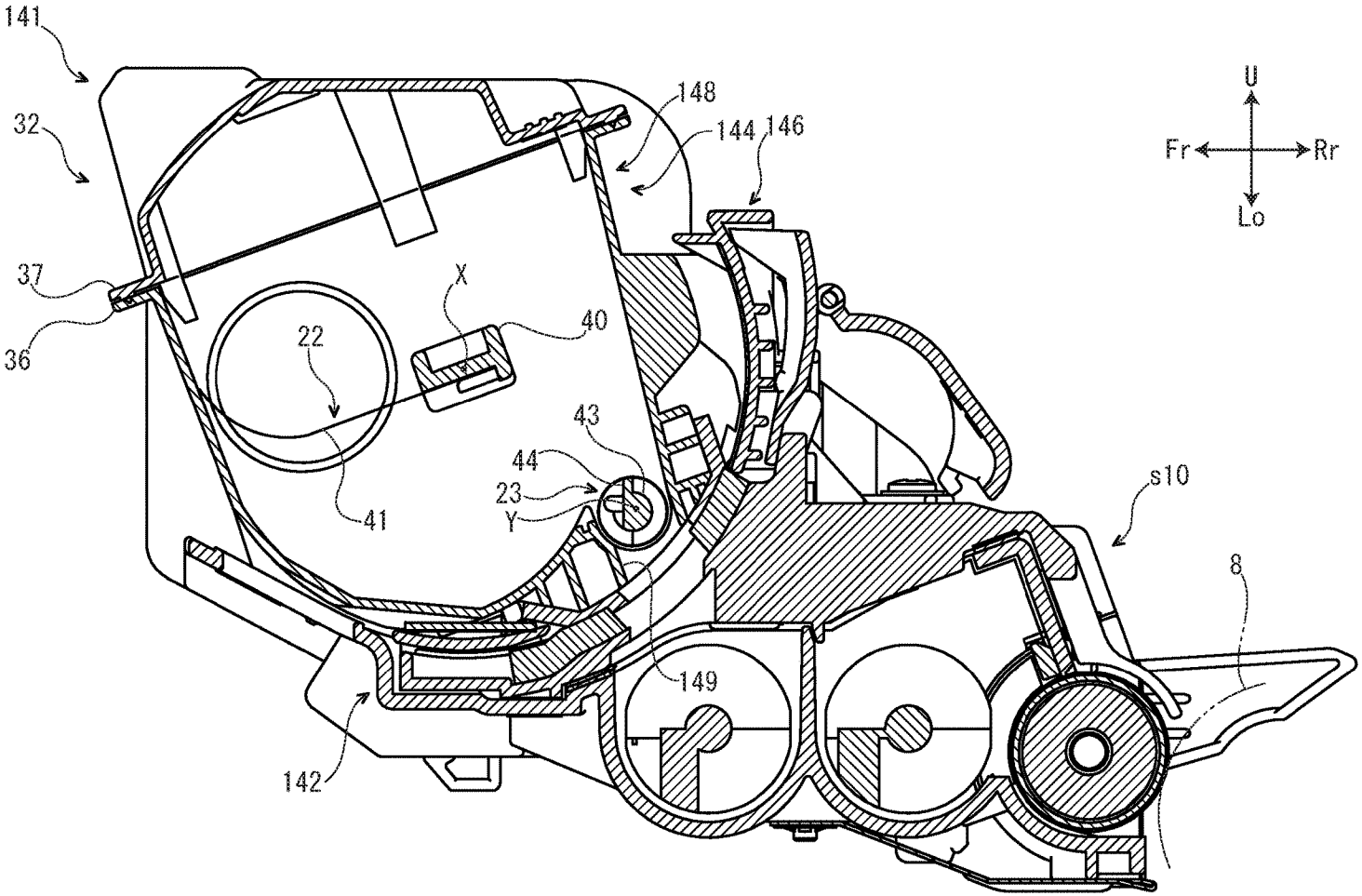
FIG. 22 is a sectional view showing a state where the case main body is in a second rotated position, in the printer according to the third embodiment of the present disclosure.

With reference to FIG. 21 and FIG. 22, a case main body 144 of the toner container 141 is rotatable between a first rotated position (refer to FIG. 21) and a second rotated position (refer to FIG. 22), in a state where the toner container 141 is attached to an attachment part 142. In a lower face of a storage 148 of the case main body 144, a discharge port 149 through which the toner is discharged is provided. The case main body 144 does not include the duct (refer to the first embodiment).

Figure 23:
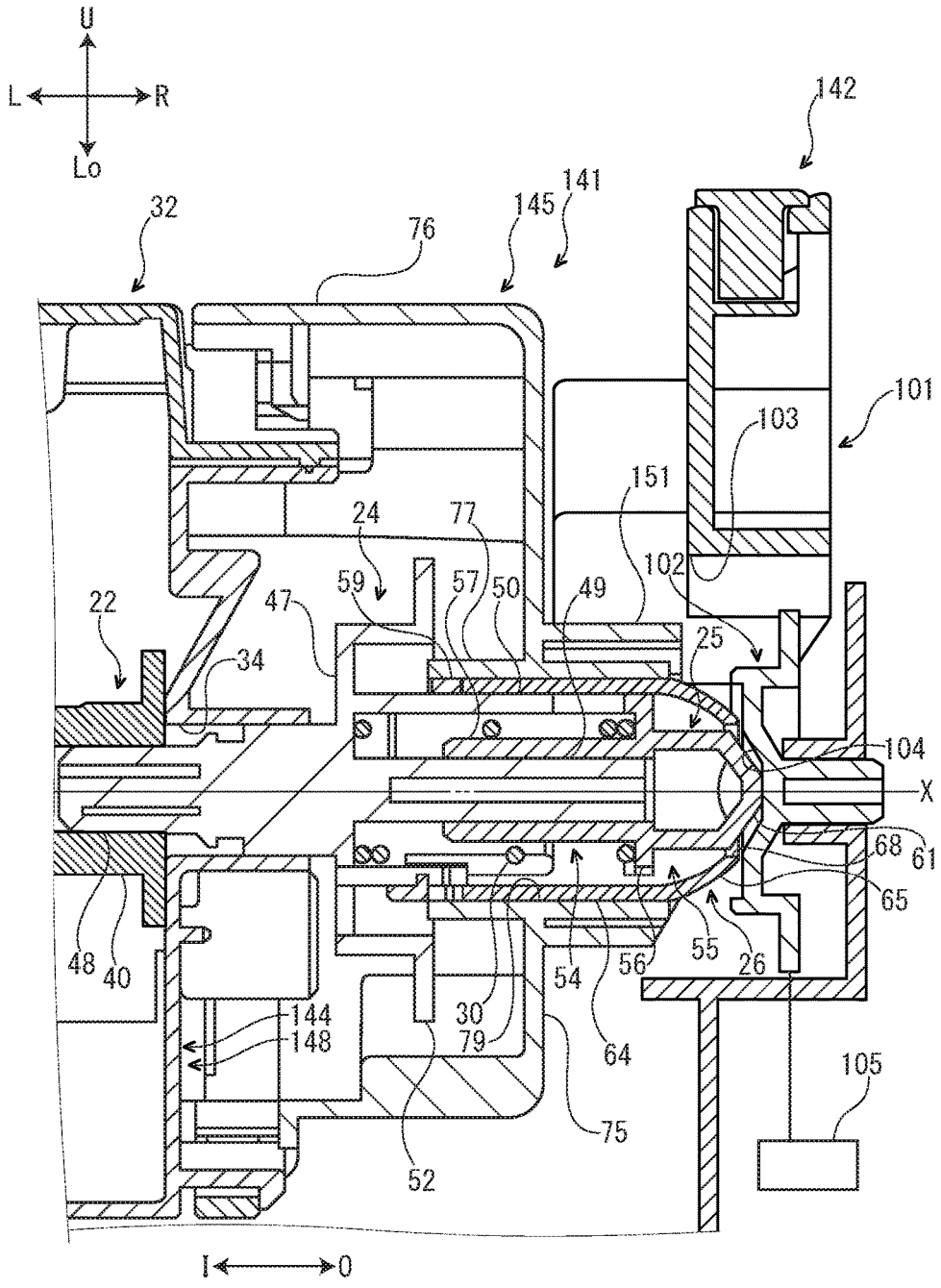
FIG. 23 is a sectional view showing a state where a toner container is attached to an attachment part, in the printer according to the third embodiment of the present disclosure.

With reference to FIG. 23, a cover 145 of the toner container 141 includes an engaging wall 151. The engaging wall 151 is protruded from the main wall 75 at the outer circumference of the through hole 79 to the right side (the outside in the left-and-right direction).

With reference to FIG. 21 and FIG. 22, a shutter 146 of the toner container 141 is curved in an arc-shape along an outer face of the storage 148 of the case main body 144. The shutter 146 is openable and closable the toner discharge port 149.

Next, an operation to set the toner container 141 to the attachment part 142 by a worker, such as a user and a serviceman, will be described.

Firstly, as the same process as the first embodiment, the worker attaches the toner container 141 to the attachment part 142 along the attachment direction Z. Thereby, as shown in FIG. 23, the transmitting coupling 61 of the transmitter 25 is coupled to the driving coupling 104 of the driving piece 102, and the transmitting coupling 61 and the driving coupling 104 are arranged on the first rotation axis X.

Next, the worker rotates the case main body 144 with respect to the shutter 146 from a first rotated position (refer to FIG. 21) to a second rotated position (refer to FIG. 22). Consequently, the case main body 144 is displaced with respect to the shutter 146, and the shutter 146 opens the toner discharge port 149. Thereby, the setting of the toner container 141 to the attachment part 142 is completed.

When the case main body 144 rotates from the first rotated position (refer to FIG. 21) to the second rotated position (refer to FIG. 22) as described above, the case main body 144 rotates around the first rotation axis X. Thereby, a relative positional relationship between the transmitting coupling 61 and the driving coupling 104 which are arranged on the first rotation axis X is not changed, and the coupling state of the transmitting coupling 61 and the driving coupling 104 can be kept.

When the worker detaches the toner container 141 from the attachment part 142, the worker rotates the case main body 144 with respect to the shutter 146 from the second rotated position (refer to FIG. 22) to the first rotated position (refer to FIG. 21). Consequently, the case main body 144 is displaced with respect to the shutter 146, and the shutter 146 closes the toner discharge port 149. Next, the worker pulls out the toner container 141 from the attachment part 142 along a direction opposing to the attachment direction Z. Thereby, the toner container 141 is detached from the attachment part 142.

In the present embodiment, as described above, as the case main body 144 rotates with respect to the shutter 146 in the state where the toner container 141 is attached to the attachment part 142, the shutter 146 opens and closes the toner discharge port 149. By applying such a configuration, it becomes possible to open and close the toner discharge port 149 without providing the manipulation member (refer to the first embodiment) in the toner container 141 and to make the structure the toner container 141 simple.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body storing a toner;

a rotator rotating around a rotation axis, at least a part of the rotator being stored in the case main body;

a transmitter arranged outside the case main body and transmitting rotation to the rotator; and a mover arranged outside the case main body and attached to the transmitter, wherein the transmitter moves along a rotation axis direction of the rotator between a first position and a second position which is arranged at an outside of the first position in the rotation axis direction, the mover moves along the rotation axis direction between a first moved position and a second moved position which is arranged at an outside of the first moved position in the rotation axis direction, as the mover moves from the second moved position to the first moved position, the transmitter moves from the second position to the first position, and as the mover moves from the first moved position to the second moved position, the transmitter moves from the first position to the second position.

2. The toner case according to claim 1, further comprising a cover covering an outside of the case main body in the rotation axis direction, wherein the transmitter includes:

an inside part covered with the cover in a state where the transmitter is in the second position; and an outside part protruding to an outside in the rotation axis direction further than the cover in the state where the transmitter is in the second position, and the mover includes:

an inside cylindrical part covering an outer circumference of the inside part; and an outside cylindrical part extending from the inside cylindrical part to an outside in the rotation axis direction and covering an outer circumference of the outside part.

3. The toner case according to claim 2, wherein an outer circumferential face of the outside cylindrical part is formed in a spherical belt-like shape.

4. The toner case according to claim 1, further comprising a cover covering an outside of the case main body in the rotation axis direction, wherein the transmitter includes:

an inside part covered with the cover in a state where the transmitter is in the second position; and an outside part protruding to an outside in the rotation axis direction further than the cover in the state where the transmitter is in the second position, and the mover includes:

a cylindrical part covering an outer circumference of the inside part;

an arm part extending from the cylindrical part to an outside in a radial direction; and a boss part extending from the arm part to an outside in the rotation axis direction, wherein an end portion of the boss part at an outside in the rotation axis direction is protruded to an outside in the rotation axis direction further than the cover.

5. The toner case according to claim 4, wherein the end portion of the boss part at the outside in the rotation axis direction is formed in a hemispherical shape.

6. The toner case according to claim 1, further comprising a biasing member biasing the transmitter to the second position, wherein as the mover moves from the second moved position to the first moved position, the mover presses the transmitter and the transmitter moves from the second position to the first position against biasing force of the biasing member, and as the mover moves from the first moved position to the second moved position, the transmitter moves from the first position to the second position by the biasing force of the biasing member.

7. The toner case according to claim 1, wherein the transmitter moves along the rotation axis direction between the first position and a third position which is arranged at an inside of the first position in the rotation axis direction, in a state where the mover is in the first moved position.

8. The toner case according to claim 1, further comprising:

a shutter opening and closing a toner discharge port provided in the case main body; and a manipulation member connected to the shutter, wherein as the manipulation member is manipulated, the shutter opens and closes the discharge port.

9. The toner case according to claim 1, further comprising a supporter connected to the rotator, wherein the transmitter is supported by the supporter in a state where the transmitter is movable along the rotation axis direction and is not rotatable with respect to the supporter.

10. An image forming apparatus comprising:

the toner case according to claim 1; and an attachment part to which the toner case is detachably attached.

11. The image forming apparatus according to claim 10, wherein the transmitter includes a transmitting coupling, the attachment part includes:

a driving coupling rotated by rotation driving force from a driving source; and a case storing the driving coupling, wherein in a middle of attaching of the toner case to the attachment part, the case presses the mover, the mover moves from the second moved position to the first moved position and the transmitter moves from the second position to the first position, and when the toner case is attached to the attachment part, pressing of the mover to the first moved position by the case is released, the mover moves from the first moved position to the second moved position, the transmitter moves from the first position to the second position and the transmitting coupling is coupled to the driving coupling.

12. The image forming apparatus according to claim 11, wherein the transmitting coupling has a different shape for every type of the toner case, and the driving coupling has a different shape for every type of the attachment part, when the type of the toner case matches the type of the attachment part, the shape of the transmitting coupling matches the shape of the driving coupling and the transmitting coupling is permitted to be coupled to the driving coupling.

13. An image forming apparatus comprising:

the toner case according to claim 1; and an attachment part to which the toner case is detachably attached, wherein the toner case further includes a shutter opening and closing a toner discharge port provided in the case main body, and as the case main body rotates with respect to the shutter in a state where the toner case is attached to the attachment part, the shutter opens or closes the discharge port.

14. The image forming apparatus according to claim 13, wherein the case main body rotates around the rotation axis.

* * * * *